US011834915B2

(12) United States Patent
Massey et al.

(10) Patent No.: US 11,834,915 B2
(45) Date of Patent: Dec. 5, 2023

(54) DOWNHOLE MOVABLE JOINT TOOL

(71) Applicant: Impact Selector International, LLC, Heath, TX (US)

(72) Inventors: James Patrick Massey, Breckenridge, CO (US); Jeremy Todd Morrison, Pickton, TX (US)

(73) Assignee: IMPACT SELECTOR INTERNATIONAL, LLC, Heath, TX (US)

( * ) Notice: Subject to any disclaimer, the term of this patent is extended or adjusted under 35 U.S.C. 154(b) by 0 days.

(21) Appl. No.: 17/446,799

(22) Filed: Sep. 2, 2021

(65) Prior Publication Data

US 2022/0065050 A1 Mar. 3, 2022

Related U.S. Application Data

(60) Provisional application No. 62/706,687, filed on Sep. 2, 2020.

(51) Int. Cl.
*E21B 17/05* (2006.01)
*E21B 17/10* (2006.01)
(Continued)

(52) U.S. Cl.
CPC ..... *E21B 17/05* (2013.01); *E21B 7/04* (2013.01); *E21B 7/06* (2013.01); *E21B 17/023* (2013.01); *E21B 17/1014* (2013.01); *E21B 17/1057* (2013.01); *E21B 17/20* (2013.01); *E21B 23/14* (2013.01)

(58) Field of Classification Search
CPC .. E21B 17/05; E21B 17/1057; E21B 17/1014; E21B 17/023; E21B 23/14
See application file for complete search history.

(56) References Cited

U.S. PATENT DOCUMENTS 2,402,238 A * 6/1946 Carpenter ..... E21B 7/06 175/45
4,442,908 A * 4/1984 Steenbock ..... E21B 7/068 175/73
(Continued)

FOREIGN PATENT DOCUMENTS

GB 2483227 A1 3/2012
WO 02/066779 A1 8/2002
(Continued)

OTHER PUBLICATIONS

PCT/US2021/071353 International Search Report and Written Opinion dated Nov. 29, 2021, 12 pages.

*Primary Examiner* — Nicole Coy
*Assistant Examiner* — Nicholas D Wlodarski
(74) *Attorney, Agent, or Firm* — Boisbrun Hofman, PLLC

(57) ABSTRACT

A downhole tool operable to connect within a downhole tool string. The downhole tool may include a first sub, a second sub, and a movable joint movably connecting the first sub and the second sub to facilitate relative angular movement between the first sub and the second sub. The downhole tool may be operable to connect together a first portion of the tool string and a second portion of the tool string and facilitate relative angular movement between the first portion of the tool string and the second portion of the tool string when the downhole tool is connected within the tool string.

19 Claims, 13 Drawing Sheets

(51) Int. Cl.

| | |
|---|---|
| ***E21B 17/02*** | (2006.01) |
| ***E21B 23/14*** | (2006.01) |
| ***E21B 17/20*** | (2006.01) |
| ***E21B 7/04*** | (2006.01) |
| ***E21B 7/06*** | (2006.01) |

(56) References Cited

U.S. PATENT DOCUMENTS

| | | | | |
|---|---|---|---|---|
| 4,842,059 | A * | 6/1989 | Tomek | E21B 17/206 285/146.1 |
| 4,880,067 | A | 11/1989 | Jelsma | |
| 5,467,834 | A | 11/1995 | Hughes et al. | |
| 5,547,032 | A * | 8/1996 | Wenzel | E21B 17/20 175/320 |
| 6,382,333 | B1 * | 5/2002 | Murray | E21B 17/1057 166/241.3 |
| 2004/0035572 | A1 | 2/2004 | Cooper | |
| 2006/0070733 | A1 | 4/2006 | Al-Zahrani | |

FOREIGN PATENT DOCUMENTS

| | | | |
|---|---|---|---|
| WO | 2011109102 | A1 | 9/2011 |
| WO | 2016170356 | A1 | 10/2016 |

* cited by examiner

DOWNHOLE MOVABLE JOINT TOOL

CROSS-REFERENCE TO RELATED APPLICATIONS

This application claims priority to and the benefit of U.S. Provisional Application No. 62/706,687, titled "DOWNHOLE MOVABLE JOINT TOOL," filed Sep. 2, 2020, the entire disclosure of which is hereby incorporated herein by reference.

BACKGROUND OF THE DISCLOSURE

Wells are generally drilled into land surface or ocean bed to recover natural deposits of oil and gas, and other natural resources that are trapped in subterranean geological formations in the Earth's crust. Testing and evaluation of completed and partially finished wells has become commonplace, such as to increase well production and return on investment. Downhole measurements of formation pressure, formation permeability, and recovery of formation fluid samples, may be useful for predicting economic value, production capacity, and production lifetime of geological formations. Completion and stimulation operations of wells, such as perforating and fracturing operations, may also be performed to optimize well productivity. Plugging and perforating tools may be utilized to set plugs within a wellbore to isolate portions of the wellbore and subterranean geological formations surrounding the wellbore from each other and to perforate the well in preparation for fracturing. Each fracturing stage interval along the wellbore can be perforated with one or more perforating tools forming one or more clusters of perforation tunnels along the wellbore. Intervention operations in completed wells, such as installation, removal, or replacement of various production equipment, may also be performed as part of well repair or maintenance operations or permanent abandonment. Such testing, completion, intervention, and other downhole operations have become complicated, as wellbores are drilled deeper and often include extensive non-vertical portions and bends.

A downhole tool may be conveyed downhole along a wellbore as part of a downhole tool string by utilizing gravity or being pushed downhole from the surface. However, a tool string that has conventionally been used in a straight and near-straight wellbore may encounter problems when used in a wellbore comprising shear offsets, lateral shifts, doglegs, and other deviations having tight bends. For example, tight bends along a casing can cause excessive friction with the tool string or cause a lower end of the tool string to jam against an inner surface of the casing, and, thus, cause the tool string to get stuck within the wellbore. Furthermore, movement of a tool string along a curved portion of a wellbore may also be impeded by presence of various obstacles within the wellbore. For example, washouts, misaligned tubular joins, transitions between lining, casing, bare sidewalls of the wellbore, and other uneven surfaces may increase resistance or impede movement of the tool string through the wellbore. Particularly with open-hole wellbores not lined with a casing, an outer surface of the tool string may stick to a side of the wellbore or an edge of the tool string may dig into or jam against imperfections along the side of the wellbore.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
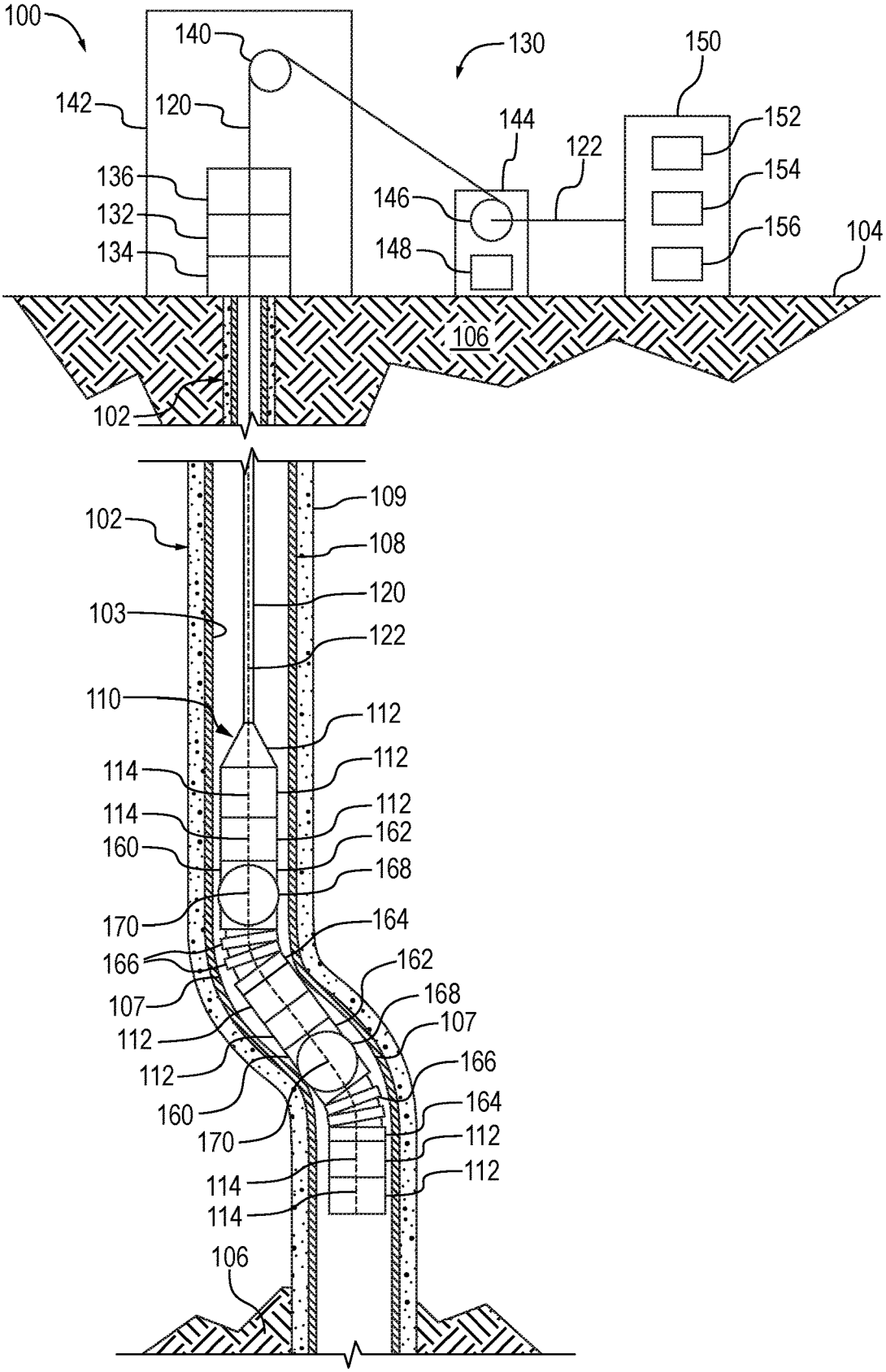
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

Terms, such as upper, upward, above, lower, downward, and/or below are utilized herein to indicate relative positions and/or directions between apparatuses, tools, components, parts, portions, members and/or other elements described herein, as shown in the corresponding figures. Such terms do not necessarily indicate relative positions and/or directions when actually implemented. Such terms, however, may indicate relative positions and/or directions with respect to a wellbore when an apparatus according to one or more aspects of the present disclosure is utilized or otherwise disposed within the wellbore. For example, the term upper may mean in the uphole direction, and the term lower may mean in the downhole direction.

FIG. 1 is a schematic view of at least a portion of an example implementation of a wellsite system 100 according to one or more aspects of the present disclosure, representing an example environment in which one or more aspects of the present disclosure may be implemented. The wellsite system 100 is depicted in relation to a wellbore 102 formed by rotary and/or directional drilling and extending from a wellsite surface 104 into a subterranean formation 106. A lower portion of the wellbore 102 is shown enlarged compared to an upper portion of the wellbore 102 adjacent the wellsite surface 104 to permit a larger and therefore a more detailed depiction of various tools, tubulars, devices, and other objects disposed within the wellbore 102. The wellsite system 100 may be utilized to facilitate recovery of oil, gas, and/or other materials that are trapped in the subterranean formation 106 via the wellbore 102. At least a portion of the wellbore 102 may be a cased-hole wellbore 102 comprising a casing 108 secured by cement 109, and/or a portion of the wellbore 102 may be an open-hole wellbore 102 lacking the casing 108 and cement 109. The wellbore 102 may also or instead contain a fluid conduit (e.g., a production tubing) (not shown) disposed within at least a portion of the casing 108 and/or an open-hole portion of the wellbore 102. Thus, one or more aspects of the present disclosure are applicable to and/or readily adaptable for utilizing in a cased-hole portion of the wellbore 102, an open-hole portion of the wellbore 102, and/or a fluid conduit disposed within a cased-hole and/or open-hole portion of the wellbore 102. It is also noted that although the wellsite system 100 is depicted as an onshore implementation, it is to be understood that the aspects described below are also generally applicable to offshore implementations.

The wellsite system 100 includes surface equipment 130 located at the wellsite surface 104. The wellsite system 100 also includes or is operable in conjunction with a downhole intervention and/or sensor assembly, referred to as a tool string 110, conveyed within the wellbore 102 along one or more subterranean formations 106 via a conveyance line 120 operably coupled with one or more pieces of the surface equipment 130. The conveyance line 120 may be operably connected with a conveyance device 140 operable to apply an adjustable downward- and/or upward-directed force to the tool string 110 via the conveyance line 120 to convey the tool string 110 within the wellbore 102. The conveyance line 120 may be or comprise coiled tubing, a cable, a wireline, a slickline, a multiline, or an e-line, among other examples. The conveyance device 140 may be, comprise, or form at least a portion of a sheave or pulley, a winch, a draw-works, an injector head, and/or other device coupled to the tool string 110 via the conveyance line 120. The conveyance device 140 may be supported above the wellbore 102 via a mast, a derrick, a crane, and/or other support structure 142. The surface equipment 130 may further comprise a reel or drum 146 configured to store thereon a wound length of the conveyance line 120, which may be selectively wound and unwound by the conveyance device 140 to selectively convey the tool string 110 into, along, and out of the wellbore 102.

Instead of or in addition to the conveyance device 140, the surface equipment 130 may comprise a winch conveyance device 144 comprising or operably connected with the drum 146. The drum 146 may be rotated by a rotary actuator 148 (e.g., an electric motor) to selectively unwind and wind the conveyance line 120 to apply an adjustable tensile force to the tool string 110 to selectively convey the tool string 110 into, along, and out of the wellbore 102.

The conveyance line 120 may comprise metal tubing, support wires, and/or cables configured to support the weight of the downhole tool string 110. The conveyance line 120 may also comprise one or more insulated electrical and/or optical conductors 122 operable to transmit electrical energy (i.e., electrical power) and electrical and/or optical signals (information or data) between the tool string 110 and one or more components of the surface equipment 130, such as a power and control system 150. The conveyance line 120 may comprise and/or be operable in conjunction with a means for communication between the tool string 110, the conveyance device 140, the winch conveyance device 144, and/or one or more other portions of the surface equipment 130, including the power and control system 150.

The wellbore 102 may be capped by a plurality (e.g., a stack) of fluid control devices 132, such as fluid control valves, spools, and fittings individually and/or collectively operable to direct and control the flow of fluid out of the wellbore 102. The fluid control devices 132 may also or instead comprise a blowout preventer (BOP) stack operable to prevent the flow of fluid out of the wellbore 102. The fluid control devices 132 may be mounted on top of a wellhead 134.

The surface equipment 140 may further comprise a sealing and alignment assembly 136 mounted on the fluid control devices 132 and operable to seal the conveyance line 120 during deployment, conveyance, intervention, and other wellsite operations. The sealing and alignment assembly 136 may comprise a lock chamber (e.g., a lubricator, an airlock, a riser, etc.) mounted on the fluid control devices 132, a stuffing box operable to seal around the conveyance line 120 at top of the lock chamber, and return pulleys operable to guide the conveyance line 120 between the stuffing box and the drum 146, although such details are not shown in FIG. 1. The stuffing box may be operable to seal around an outer surface of the conveyance line 120, for example via annular packings applied around the surface of the conveyance line 120 and/or by injecting a fluid between the outer surfaces of the conveyance line 120 and an inner wall of the stuffing box. The tool string 110 may be deployed into or retrieved from the wellbore 102 via the conveyance device 140 and/or winch conveyance device 144 through the fluid control devices 132, the wellhead 134, and/or the sealing and alignment assembly 136.

The power and control system 150 (e.g., a control center) may be utilized to monitor and control various portions of the wellsite system 100. The power and control system 150 may be located at the wellsite surface 104 or on a structure located at the wellsite surface 104. However, the power and control system 150 may instead be located a remote location from the wellsite surface 104. The power and control system 150 may include a source of electrical power 152, a control workstation 154, and a surface controller 156 (e.g., a processing device or computer). The surface controller 156 may be communicatively connected with various equipment of the wellsite system 100, such as may permit the surface controller 156 to monitor operations of one or more portions of the wellsite system 100 and/or to provide control of one or more portions of the wellsite system 100, including the tool string 110, the conveyance device 140, and/or the winch conveyance device 144. The control workstation 154 may be communicatively connected with the surface controller 156 and may include input devices for receiving the control data from a human wellsite operator and output devices for displaying sensor data and other information to the human wellsite operator. The surface controller 156 may be operable to receive and process sensor data or information from the tool string 110 and/or control data (i.e., control commands) entered to the surface controller 156 by the human wellsite operator via the control workstation 154. The surface controller 156 may store executable computer programs and/or instructions and may be operable to implement or otherwise cause one or more aspects of methods, processes, and operations described herein based on the executable computer programs, the received sensor data, and the received control data.

The tool string 110 may be conveyed within the wellbore 102 to perform various downhole sampling, testing, intervention, and other downhole operations. The tool string 110 may further comprise one or more downhole tools 112 (e.g., devices, modules, etc.) operable to perform such downhole operations. The downhole tools 112 of the tool string 110 may each be or comprise an acoustic tool, a cable head, a casing collar locator (CCL), a cutting tool, a density tool, a depth correlation tool, a directional tool, an electrical power module, an electromagnetic (EM) tool, a formation testing tool, a fluid sampling tool, a gamma ray (GR) tool, a gravity tool, a formation logging tool, a hydraulic power module, a magnetic resonance tool, a formation measurement tool, a jarring tool, a mechanical interface tool, a monitoring tool, a neutron tool, a nuclear tool, a perforating tool, a photoelectric factor tool, a plug, a plug setting tool, a porosity tool, a power module, a ram, a reservoir characterization tool, a resistivity tool, a seismic tool, a stroker tool, a surveying tool, and/or a telemetry tool, among other examples also within the scope of the present disclosure.

The tool string 110 may further comprise one, two, three, four, five, or more movable joint tools 160 (referred to hereinafter as "joint tools") connected within or along the tool string 110. For example, the joint tools 160 may be coupled with, between, and/or on opposing sides of various portions (e.g., downhole tools 112) of the tool string 110. Each joint tool 160 may be operable to flexibly or otherwise movably connect adjacent portions (e.g., downhole tools 112) of the tool string 110 coupled with the joint tool 160 to permit bending of the tool string 110 and, thus, permit, help, or otherwise facilitate conveyance of the tool string 110 past or through shear offsets, lateral shifts, doglegs, and other deviations having tight bends 107 along the wellbore 102.

Each joint tool 160 may comprise an upper sub 162 (e.g., a subassembly or section) operable to be connected with an upper adjacent portion of the tool string 110, and a lower sub 164 (e.g., a subassembly or section) operable to be connected with a lower adjacent portion of the tool string 110. Each joint tool 160 may further comprise one or more movable (e.g., flexible or bendable) joints 166 collectively operable to facilitate relative movement (e.g., angular movement and/or lateral movement) between the upper sub 162 and the lower sub 164, and, thus, facilitate relative movement between the upper adjacent portion of the tool string 110 and the lower adjacent portion of the tool string 110.

One or more of the joint tools 160 may further comprise a plurality of wheels 168, each rotatably connected to the upper sub 162 and/or the lower sub 164. The wheels 168 may be operable to reduce friction between the tool string 110 and an inner surface 103 (i.e., a sidewall) of the wellbore 102 (e.g., an inner surface of the formation 106 if the wellbore 102 is an open-hole wellbore, an inner surface of the casing 108, if installed, or an inner surface of the fluid conduit, if installed) to facilitate downhole conveyance of the tool string 110 axially along the wellbore 102. For example, the wheels 168 may contact the inner surface 103 of the wellbore 102 along the bends 107 to reduce friction between the tool string 110 and the inner surface 103 of the wellbore 102 when the tool string 110 passes through the bends 107 of the wellbore 102. Although FIG. 1 depicts the tool string 110 comprising two joint tools 160 coupled along the tool string 110, it is to be understood that the tool string 110 may include one, three, four, five, or more joint tools 160.

Each downhole tool 112 may comprise or contain at least one electrical conductor 114 extending therethrough and each joint tool 160 may comprise or contain at least one electrical conductor 170 extending therethrough. The electrical conductors 114, 170 may be interconnected and the conductor 114 of an uppermost one of the downhole tools 112 may be connected with the conductor 122. Thus, one or more of the downhole tools 112 and/or the joint tools 160 may be electrically and/or communicatively connected with one or more components of the surface equipment 130, such as the power and control system 150, via the electrical conductors 114, 122, 170. The electrical conductors 114, 122, 170 may transmit and/or receive electrical power, signals (e.g., sensor data and/or control data), and/or other information between the power and control system 150 and one or more of the downhole tools 112. The conductors 114, 170 may further facilitate electrical communication between two or more of the downhole tools 112. Each of the downhole tools 112 and the joint tools 160 may comprise one or more electrical connectors and/or interfaces, such as may mechanically, electrically, and/or communicatively connect the electrical conductors 114, 122, 170.

Figure 2:
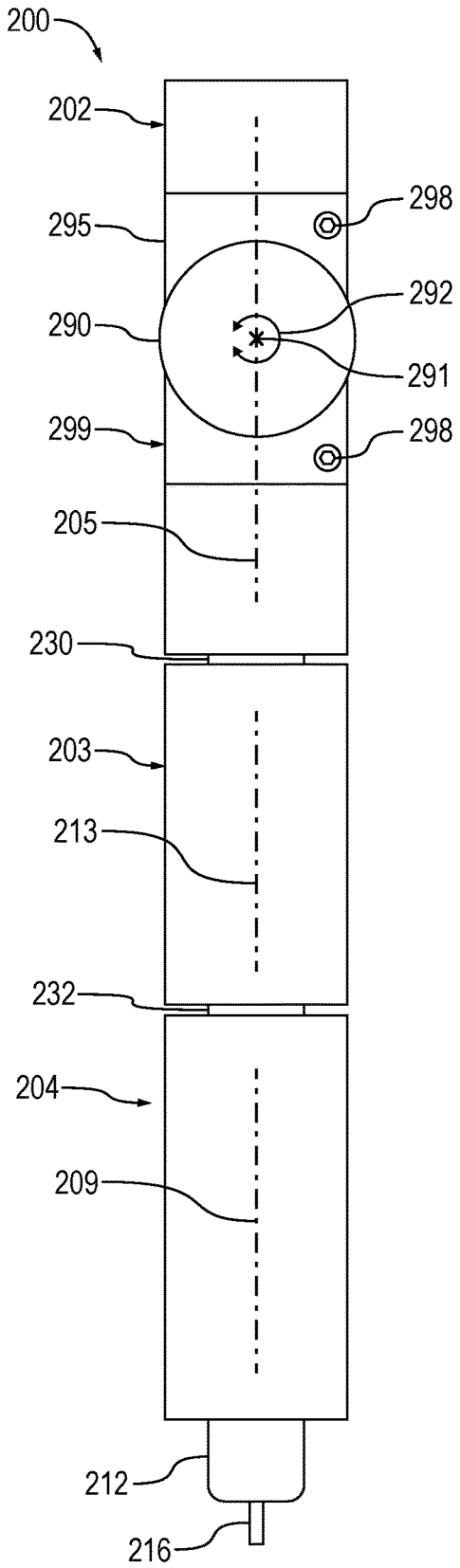
FIG. 2 is a side view of at least a portion of an example implementation of apparatus according to one or more aspects of the present disclosure.
Figure 3:
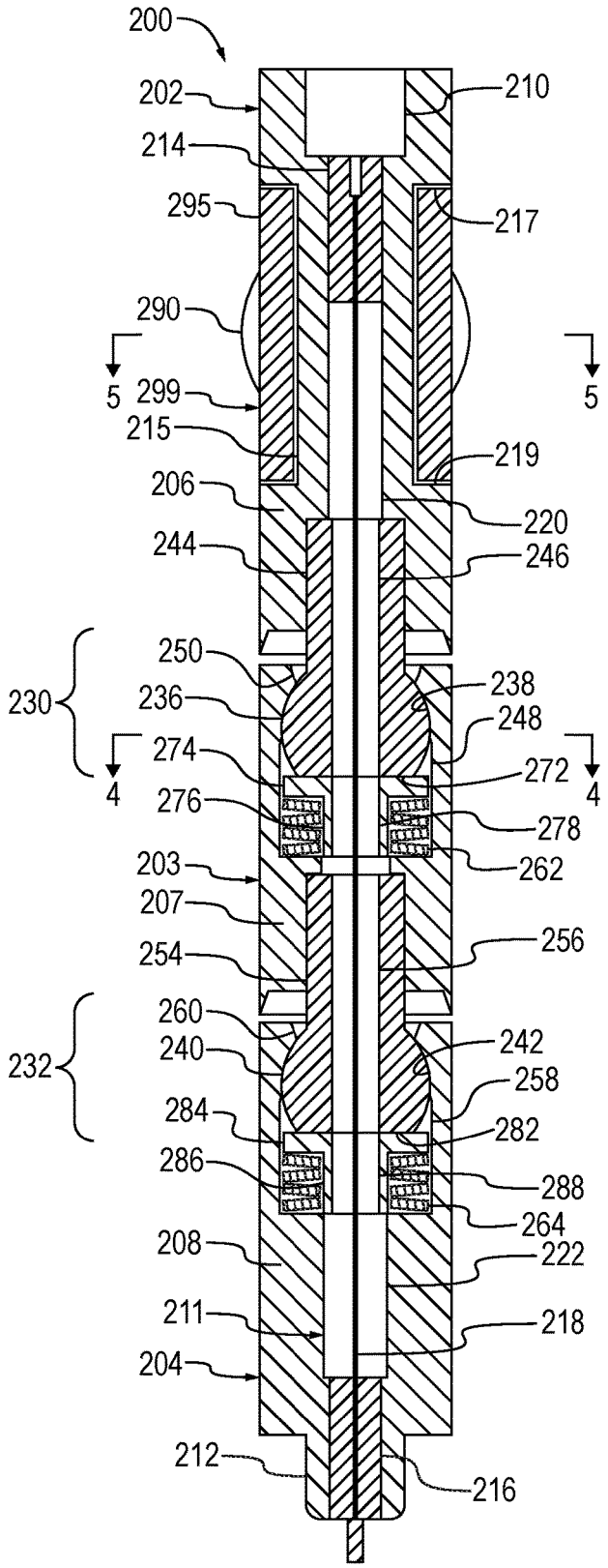
FIG. 3 is a sectional side view of the apparatus shown in FIG. 2.

FIGS. 2 and 3 are side and sectional side views, respectively, of at least a portion of an example implementation of a movable joint tool 200 (referred to hereinafter as "a joint tool") according to one or more aspects of the present disclosure. The joint tool 200 may be coupled within or along a tool string 110 and may comprise one or more features and/or modes of operation of the joint tools 160 described above and shown in FIG. 1. The tool string 110 may include one, two, three, four, five, or more joint tools 200. Accordingly, the following description refers to FIGS. 1-3, collectively.

An upper end of the joint tool 200 may include an upper sub 202 (e.g., a subassembly or section) for mechanically and/or electrically coupling the joint tool 200 with a corresponding interface (not shown) of a downhole tool 112 of a portion of a tool string 110 located above the joint tool 200. A lower end of the joint tool 200 may include a lower sub 204 (e.g., a subassembly or section) for mechanically and/or electrically coupling the joint tool 200 with a corresponding interface (not shown) of a downhole tool 112 of a portion of the tool string 110 located below the joint tool 200.

The upper and lower subs 202, 204 may each comprise a corresponding body 206, 208 (e.g., a housing) defining or otherwise encompassing a plurality of internal spaces or volumes containing various components of the joint tool 200. Although each body 206, 208 is shown as comprising a single unitary member, it is to be understood that each body 206, 208 may be or comprise a plurality of body sections or other components coupled together to form the body 206, 208. The body 206 may comprise a mandrel 215 (e.g., a rod or shaft) having an outer diameter that is appreciably smaller than an outer diameter of portions of the body 206 located above and below the mandrel 215. A corresponding shoulder 217, 219 may terminate the mandrel 215 on each upper and lower side of the mandrel 215. The body 206 (including the mandrel 215) may define a longitudinal passage 220 (e.g., a bore) extending axially therethrough, and the body 208 may define a longitudinal passage 222 (e.g., a bore) extending axially therethrough.

The upper sub 202 may comprise an upper mechanical interface means 210 (e.g., a mechanical connector, a coupler, a crossover, etc.) for mechanically coupling the joint tool 200 with a corresponding mechanical interface (not shown) of the downhole tool 112 of the portion of the tool string 110 located above the joint tool 200. The interface means 210 may be integrally formed with the body 206 of the upper sub 202 or coupled thereto, such as via a threaded connection. The lower sub 204 may comprise a lower mechanical interface means 212 (e.g., a mechanical connector, a coupler, a crossover, etc.) for mechanically coupling the joint tool 200 with a corresponding mechanical interface (not shown) of the downhole tool 112 of the portion of the tool string 110 located below the joint tool 200. The interface means 212 may be integrally formed with the body 208 of the lower sub 204 or coupled thereto, such as via a threaded connection. The interface means 210, 212 may be or comprise threaded connectors, fasteners, box couplings, pin couplings, and/or other mechanical coupling means. Although the interface means 210, 212 are shown implemented as a box connector and a pin connector, respectively, the interface means 210 may instead be implemented as a pin connector and/or the interface means 212 may instead be implemented as a box connector.

The upper sub 202 may further comprise an upper electrical interface means 214 (e.g., an upper electrical connector) for electrically coupling with a corresponding electrical interface (not shown) of the downhole tool 112 of the portion of the tool string 110 located above the joint tool 200. The lower sub 204 may further comprise a lower electrical interface means 216 for electrically coupling with a corresponding electrical interface (not shown) of the downhole tool 112 of the portion of the tool string 110 located below the joint tool 200. The electrical interface means 214, 216 may each comprise an electrical connector, a plug, a pin, a receptacle, a terminal, a conduit box, and/or other electrical connector disposed within or along a corresponding passage 220, 222. The electrical interface means 214, 216 may also or instead each comprise a bulkhead connector disposed within or along a corresponding passage 220, 222 and configured to fluidly seal against a corresponding body 206, 208 to prevent or inhibit fluid communication between opposing sides of the electrical interface means 214, 216. Although the electrical interface means 214, 216 are shown implemented as a box connector and a pin connector, respectively, the interface means 214 may instead be implemented as a pin connector and/or the interface means 216 may instead be implemented as a box connector. The mandrel 215 may be located below the upper mechanical interface means 210 and/or the upper electrical interface means 214.

The joint tool 200 may further comprise a plurality of movable joints 230, 232 connected between and connecting together the upper sub 202 and the lower sub 204. The movable joints 230, 232 may collectively facilitate relative movement between the upper sub 202 and the lower sub 204 and, thus, facilitate relative movement between a portion of the tool string 110 connected above the joint tool 200 and a portion of the tool string 110 connected below the joint tool 200. Each movable joint 230, 232 may permit angular movement (e.g., bending or flexing) of adjacent portions (e.g., subs) of the joint tool 200. The movable joints 230, 232 may be connected at different axial positions (e.g., in series) along the joint tool 200 (i.e., at different vertical positions or heights with respect to the wellbore 102 the joint tool 200 is conveyed within), thereby permitting angular movement of the joint tool 200 at a plurality of different axial positions along the joint tool 200.

Figure 4:
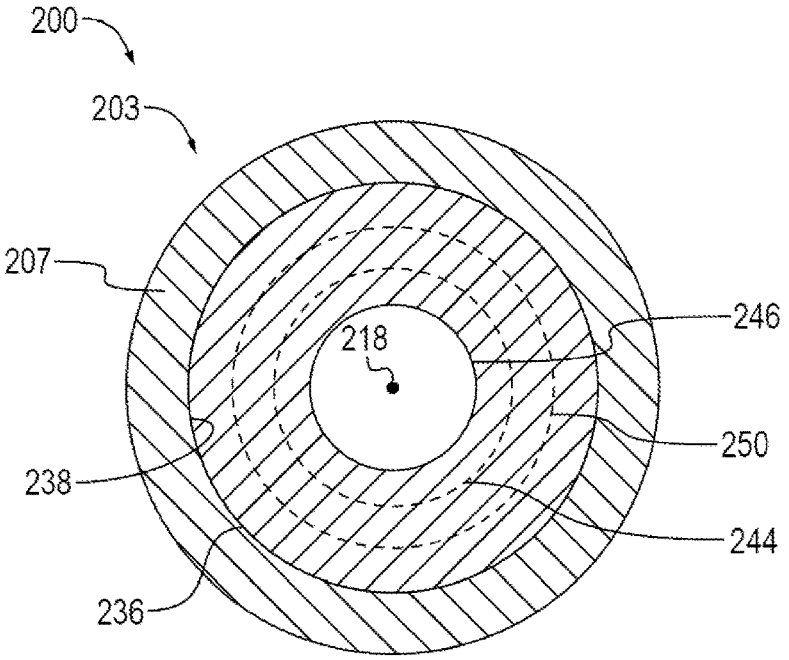
FIG. 4 is a sectional axial view of a portion of the apparatus shown in FIG. 3.

FIG. 4 is an enlarged sectional axial view of a portion of the joint tool 200 shown in FIG. 3. The following description refers to FIGS. 1-4, collectively.

The joint tool 200 may further comprise an intermediate sub 203 (e.g., a subassembly or section) connected between the upper sub 202 and the lower sub 204 via the movable joints 230, 232. The intermediate sub 203 may comprise a body 207 (e.g., a housing) defining or otherwise encompassing a plurality of internal spaces or volumes containing various components of the joint tool 200. Although the body 207 is shown as comprising a single unitary member, it is to be understood that the body 207 may be or comprise a plurality of body sections or other components coupled together to form the body 207.

The upper sub 202 and the intermediate sub 203 may be movably connected via the upper movable joint 230, and the intermediate sub 203 and the lower sub 204 may be movably connected via the lower movable joint 232. Thus, the upper movable joint 230 may permit angular movement between the upper sub 202 and the intermediate sub 203, and the lower movable joint 232 may permit angular movement between the intermediate sub 203 and the lower sub 204. Each of the movable joints 230, 232 may be or comprises a ball and socket joint. For example, the upper movable joint 230 may comprise an upper ball member 236 and an upper socket member 238, and the lower movable joint 232 may comprise a lower ball member 240 and a lower socket member 242. The upper ball member 236 and the upper socket member 238 may be movably (e.g., pivotably) connected, and the lower ball member 240 and the lower socket member 242 may be movably (e.g., pivotably) connected.

The joint 230 may further comprise a rod 244 extending between and connecting the subs 202, 203. For example, an upper end of the rod 244 may be integrally formed with or otherwise fixedly connected to the body 206 of the upper sub 202 and a lower end of the rod 244 may be integrally formed with or otherwise fixedly connected to the ball member 236. The upper end of the rod 244 may comprise a threaded portion threadedly engaging a lower end of the body 206 of the upper sub 202. The upper ball member 236 and the rod 244 may comprise or define a longitudinal passage 246 (e.g., a bore) extending axially therethrough. The passages 220, 246 may be aligned or otherwise connected. The upper socket member 238 may comprise or define a cavity 248 (or chamber) configured to accommodate the upper ball member 236 therein. An axial opening 250 of the cavity 248 may be smaller than the upper ball member 236 and/or larger than the rod 244. The cavity 248 may thus retain the upper ball member 236 and permit limited relative angular movement between the upper ball member 236 and the upper socket member 238. The upper socket member 238 may be integrally formed with or fixedly connected to a body 207 of the intermediate sub 203. The upper socket member 238 may thus be or form a portion of the intermediate sub 203. Axial profiles of the rod 244 and the axial opening 250 are also shown in FIG. 4 for clarity.

The joint 232 may further comprise a rod 254 extending between and connecting the subs 203, 204. For example, an upper end of the rod 254 may be integrally formed with or otherwise fixedly connected to the body 207 of the intermediate sub 203 and a lower end of the rod 254 may be integrally formed with or otherwise fixedly connected to the lower ball member 240. The upper end of the rod 254 may comprise a threaded portion threadedly engaging a lower end of the body 207 of the intermediate sub 203. Accordingly, the lower ball member 240 and the upper socket member 238 may be fixedly connected. The rod 254 may comprise a threaded portion threadedly engaging a lower end of the intermediate sub 203. The lower ball member 240 and the rod 254 may comprise or define a longitudinal passage 256 (e.g., a bore) extending axially therethrough. The passages 222, 256 may be aligned or otherwise connected. The lower socket member 242 may comprise or define a cavity 258 (or chamber) configured to accommodate the lower ball member 240 therein. An axial opening 260 of the cavity 258 may be smaller than the lower ball member 240 and/or larger than the rod 254. The cavity 258 may thus retain the lower ball member 240 and permit limited relative angular movement between the lower ball member 240 and the lower socket member 242. The lower socket member 242 may be integrally formed with or fixedly connected to the body 208 of the lower sub 204. The lower socket member 242 may thus be or form a portion of the lower sub 204.

The joint tool 200 may further comprise an upper biasing member 262 disposed in association with the upper movable joint 230 and a lower biasing member 264 disposed in association with the lower movable joint 232. Each biasing member 262, 264 may be or comprise a compression spring, such as a coil spring or a plurality of Belleville springs. The upper biasing member 262 may be operable to bias or otherwise urge movement of the upper movable joint 230 to a position in which a central axis 205 of the upper sub 202 and a central axis 213 of the intermediate sub 203 are substantially axially aligned (i.e., collinear or coaxial). The lower biasing member 264 may be operable to bias or otherwise urge movement of the lower movable joint 232 to a position in which the central axis 213 of the intermediate sub 203 and a central axis 209 of the lower sub 204 are substantially axially aligned. Substantially axially aligned may comprise a range between fully axially aligned (i.e., zero degrees difference) and almost fully axially aligned (e.g., a difference of five degrees or less).

Figure 7:
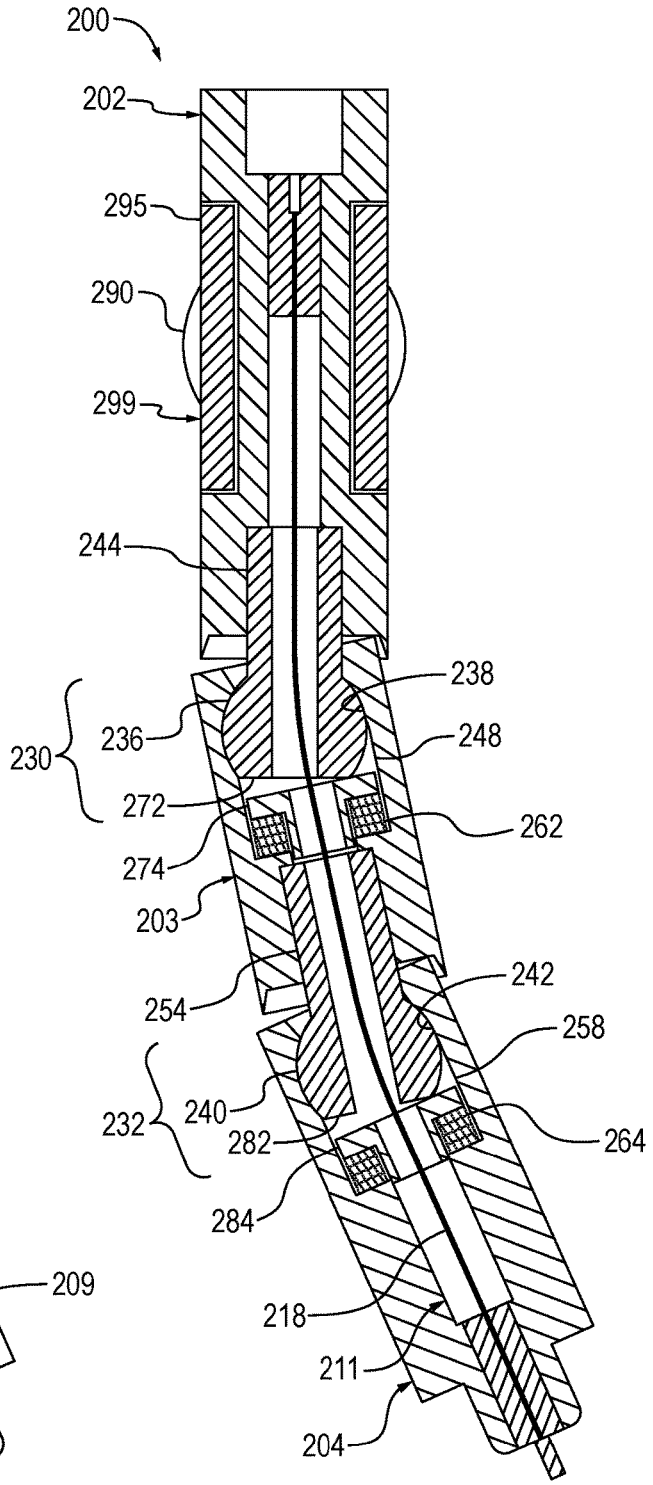
FIG. 7 is a sectional side view of the apparatus shown in FIG. 6.
Figure 9:
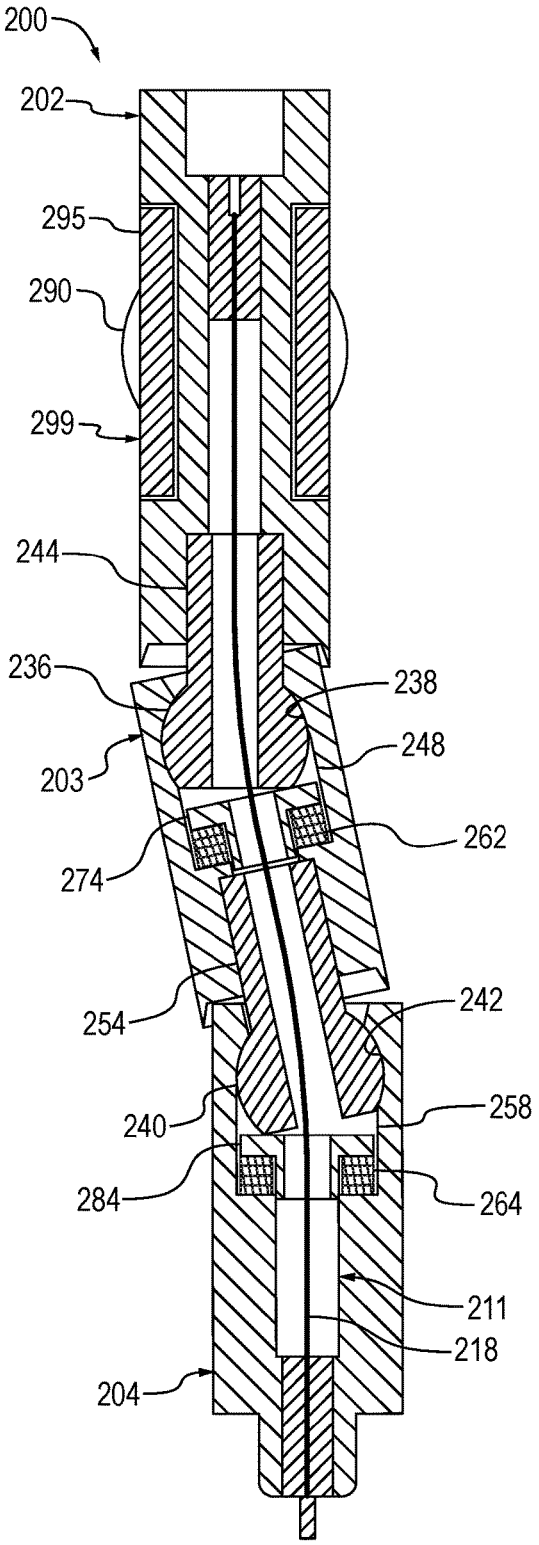
FIG. 9 is a sectional side view of the apparatus shown in FIG. 8.

The upper biasing member 262 may be disposed within the cavity 248 and operable to apply an expansion force against the upper ball member 236 and the intermediate sub 203 to thereby apply a biasing force that urges relative angular movement (i.e., pivoting) between the upper ball member 236 and the upper socket member 238 such that the central axis 205 of the upper sub 202 and the central axis 213 of the intermediate sub 203 are substantially axially aligned. The upper ball member 236 may comprise a face 272 (i.e., a flat surface) extending perpendicularly with respect to the central axis 205 of the upper sub 202. The joint tool 200 may further comprise a ring 274 movingly disposed within the cavity 248. The ring 274 may be a plate having a passage (e.g., an axial bore) extending therethrough. The ring 274 may comprise a face (i.e., a flat surface) extending perpendicularly with respect to the central axis 213 of the intermediate sub 203. The face of the ring 274 may be positioned against the face 272 of the upper ball member 236. The biasing member 262 may force the face of the ring 274 against the face 272 of the upper ball member 236. When the face of the ring 274 and the face 272 of the upper ball member 236 are at a relative angel (not flush, such as shown in FIGS. 7 and 9), the biasing member 262 generates a torque that biases or otherwise urges relative movement of the intermediate sub 203 and the upper ball member 236 to a position in which the face of the ring 274 is flush against (parallel with) the face 272 of the upper ball member 236. In such position of the ring 274 and the upper ball member 236, the central axis 205 of the upper sub 202 and the central axis 213 of the intermediate sub 203 may be substantially axially aligned. The ring 274 may be connected to a sleeve 276 (e.g., a tube) configured to maintain the ring 274 in a position in which its face extends perpendicularly with respect to the central axis 213 of the intermediate sub 203. The ring 274 and the sleeve 276 may collectively comprise or define a longitudinal passage 278 (e.g., a bore) extending axially therethrough. The passages 256, 278 may be aligned, and the passages 220, 246, 256, 278 may be aligned when the face of the ring 274 is flush against the face 272 of the upper ball member 236.

The lower biasing member 264 may be disposed within the cavity 258 and operable to apply an expansion force against the lower ball member 240 and the lower sub 204 to thereby apply a biasing force that urges relative angular movement (i.e., pivoting) between the lower ball member 240 and the lower socket member 242 such that the central axis 209 of the lower sub 204 and the central axis 213 of the intermediate sub 203 are substantially axially aligned. The lower ball member 240 may comprise a face 282 (i.e., a flat surface) extending perpendicularly with respect to the central axis 213 of the intermediate sub 203. The joint tool 200 may further comprise a ring 284 movingly disposed within the cavity 258. The ring 284 may be a plate having a passage (e.g., an axial bore) extending therethrough. The ring 284 may comprise a face (i.e., a flat surface) extending perpendicularly with respect to the central axis 209 of the lower sub 204. The face of the ring 284 may be positioned against the face 282 of the lower ball member 240. The biasing member 264 may force the face of the ring 284 against the face 282 of the lower ball member 240. When the face of the ring 284 and the face 282 of the lower ball member 240 are at a relative angel (not flush, such as shown in FIGS. 7 and 9), the biasing member 264 generates a torque that biases or otherwise urges relative movement of the lower sub 204 and the lower ball member 240 to a position in which the face of the ring 284 is flush against the face 282 of the lower ball member 240. In such position of the ring 284 and the lower ball member 240, the central axis 213 of the intermediate sub 203 and the central axis 209 of the lower sub 204 may be substantially axially aligned. The ring 284 may be connected to a sleeve 286 (e.g., a tube) configured to maintain the ring 284 in a position in which its face extends perpendicularly with respect to the central axis 209 of the lower sub 204. The ring 284 and the sleeve 286 may collectively comprise or define a longitudinal passage 288 (e.g., a bore) extending axially therethrough. The passages 222, 288 may be aligned, and the passages 222, 256, 288 may be aligned when the face of the ring 284 is flush against the face 282 of the lower ball member 240.

The passages 220, 222, 246, 256, 278, 288 and the cavities 248, 258 may collectively form a central passage 211 extending between the opposing electrical interface means 214, 216. An electrical conductor 218 may extend between the electrical interface means 214, 216 through the central passage 211, such as may facilitate electrical connection and communication between the electrical interface means 214, 216 and the downhole tools 112 connected above and below the joint tool 200.

Figure 5:
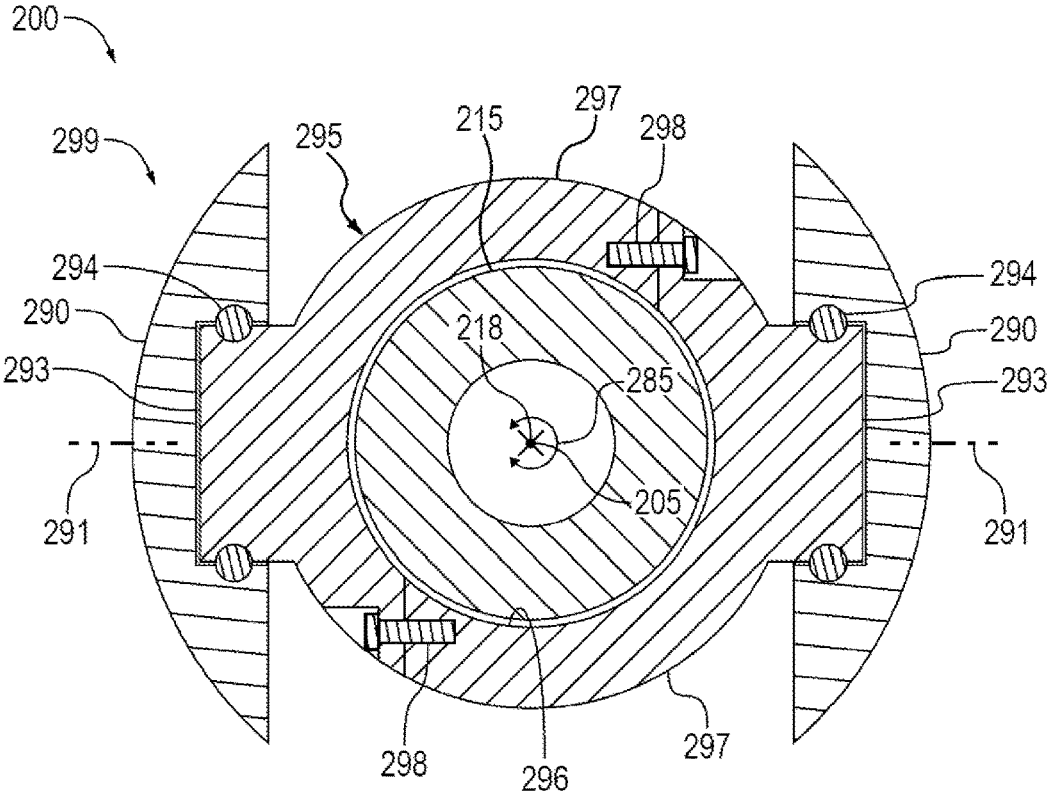
FIG. 5 is a sectional axial view of another portion of the apparatus shown in FIG. 3.

FIG. 5 is an enlarged sectional axial view of a portion of the joint tool 200 shown in FIG. 3. The following description refers to FIGS. 1-5, collectively.

The joint tool 200 may further comprise a plurality of rotatable members 290 (e.g., wheels or rollers) rotatably connected with the upper sub 202 and extending laterally outward (i.e., radially outward with respect the central axis 205) from an outer surface of the body 206. Each rotatable member 290 may be rotatable about a corresponding axis of rotation 291, as indicated by arrow 292, extending perpendicularly or otherwise laterally with respect to the central axis 205 and/or the body 206 of the upper sub 202. The rotatable members 290 may support the upper sub 202 and, thus, a portion of the tool string 110 connected with the upper sub 202 at an intended offset distance from a sidewall of the wellbore 102. The rotatable members 290 may thus collectively help or facilitate axial movement of the joint tool 200 along the sidewall of the wellbore 102 through tight bends 107 along the wellbore 102 and, thus, help or facilitate downhole conveyance of the downhole tools 112 coupled with the joint tool 200. The rotatable members 290 may also collectively revolve, swivel, roll, or otherwise rotate around the central axis 205 of the upper sub 202 or otherwise around the body 206 of the upper sub 202, as indicated by arrow 285. The rotatable members 290 may thus collectively rotate 292 (or pivot) with respect to the subs 202, 203, 204 of the joint tool 200 and/or with respect to the downhole tools 112 as the tool string 110 is conveyed along the wellbore 102. The collective rotation 292 of the rotatable members 290 around the central axis 205 of the upper sub 202 may also or instead permit collective rotation of the subs 202, 203, 204 and/or the downhole tools 112 as the tool string 110 is conveyed along the wellbore 102.

Each rotatable member 290 may be configured to rotate about a corresponding axel 293 extending radially (or laterally) outward from the central axis 205. Each rotatable member 290 may be disk or bowl shaped, comprising a convex outer surface and a curved axial profile (viewed from a perspective along the central axis 205) representing a segment of a spheroid having a radius that is smaller than a radius of a cross-section of the wellbore 102. A bearing 294 (e.g., a plain bearing, a ball bearing, a fluid bearing, and/or a composite bearing) may reduce rotational friction between each axel 293 and a corresponding rotatable member 290. A friction reducing lubricant may be applied into an internal space between each rotatable member 290 and the corresponding axle 293.

Each rotatable member 290 may be connected on an opposing side of the body 206 of the upper sub 202. The axis of rotation 291 of each rotatable member 290 may be axially aligned. Although the joint tool 200 is shown comprising two rotatable members 290, it is to be understood that the joint tool 200 may comprise three, four, or more rotatable members 290 connected to the upper sub 202. Furthermore, the rotatable members 290 may not necessarily be arranged in pairs. Accordingly, each rotatable member 290, corresponding axel 293, and corresponding axis of rotation 291 may be located at a different axial position (vertical position or height) along the upper sub 202 such that the axis of rotation 291 of each rotatable member 290 on one side of the body 206 is not axially aligned (does not axially coincide) with the axis of rotation 291 of another rotatable member 290 on an opposing side of the body 206.

The joint tool 200 may further comprise a clamp assembly 295 (e.g., a hub) operable to connect the rotatable members 290 to the body 206 of the upper sub 202. The axels 293 may be connected with or comprise a portion of the clamp assembly 295, thereby connecting the rotatable members 290 with the clamp assembly 295. For example, the axles 293 may be integrally formed with the clamp assembly 295, or the axles 293 may be fixedly connected with the clamp assembly 295, such as via threads, keys, gears, splines, snap rings, screws, bolts, interference fit, or other coupling means. The clamp assembly 295, the axels 293, and the rotatable members 290 may be collectively referred to as a roller/clamp assembly 299.

The clamp assembly 295 may comprise an inner surface 296 defining a bore configured to receive or accommodate the mandrel 215 and, thus, connect the roller/clamp assembly 299 to the body 206 of the upper sub 202. The clamp assembly 295 may be operable to clamp around or otherwise engage the body 206 in a manner preventing axial movement and permitting rotation of the roller/clamp assembly 299 with respect to the body 206. The clamp assembly 295 may engage (be disposed circumferentially around) the mandrel 215 in a manner preventing axial movement of the roller/clamp assembly 299 along the mandrel 215 and permitting rotation of the roller/clamp assembly 299 around the mandrel 215. The clamp assembly 295 may permit the rotatable members 290 to collectively revolve, swivel, or otherwise rotate about the central axis 205 of the upper sub 202, as indicated by the arrow 285. For example, the inner surface 296 of the clamp assembly 295 may define the bore having a slightly larger inner diameter than the outer diameter of the mandrel 215. Accordingly, in an example implementation, the clamp assembly 295 may not be compressed against the mandrel 215, thereby maintaining an annular space (i.e., a gap) between the clamp assembly 295 and the mandrel 215, thereby permitting the roller/clamp assembly 299 to rotate around the mandrel 215. A friction reducing member (e.g., a plain bearing, a ball bearing, a fluid bearing, and/or a composite bearing) (not shown) may be disposed between the inner surface 296 of the clamp assembly 295 and the outer surface of the mandrel 215 to facilitate rotational movement of the roller/clamp assembly 299 around the mandrel 215. Each opposing (upper and lower) end of the clamp assembly 295 may contact, abut, or otherwise engage a corresponding shoulder 217, 219 of the body 206 to prevent axial movement of the roller/clamp assembly 299 along the mandrel 215.

The clamp assembly 295 may comprise two or more clamp portions operable to be detachably connected with each other to form the clamp assembly 295 and to facilitate mounting of the clamp assembly 295 around the mandrel 215 of the body 206. For example, the clamp assembly 295 may comprise complimentary clamp portions 297 configured to be detachably connected to each other via one or more fasteners 298, such as bolts. Each axle 293 and, thus, each rotating member 290 may be connected with a corresponding one of the clamp portions 297. The clamp portions 297 may be disposed on opposing sides of the mandrel 215 such that the inner surfaces 296 of the clamp portions 297 may collectively extend around the mandrel 215. The fasteners 298 may be inserted through openings in the clamp portions 297 and threadedly engaged with corresponding threaded openings in the clamp portions 297 to connect the clamp portions 297 together. Although the clamp portions 297 are shown as being connected via a plurality of bolts, the clamp portions 297 may be detachably connected together about the mandrel 215 via other means, such as interlocking fasteners, retaining pins, and press/interference fit, among other examples. Although the joint tool 200 is shown comprising the roller/clamp assembly 299 connected with the upper sub 202, it is to be understood that the roller/clamp assembly 299 may also or instead be connected with the intermediate sub 203 and/or the lower sub 204.

Figure 6:
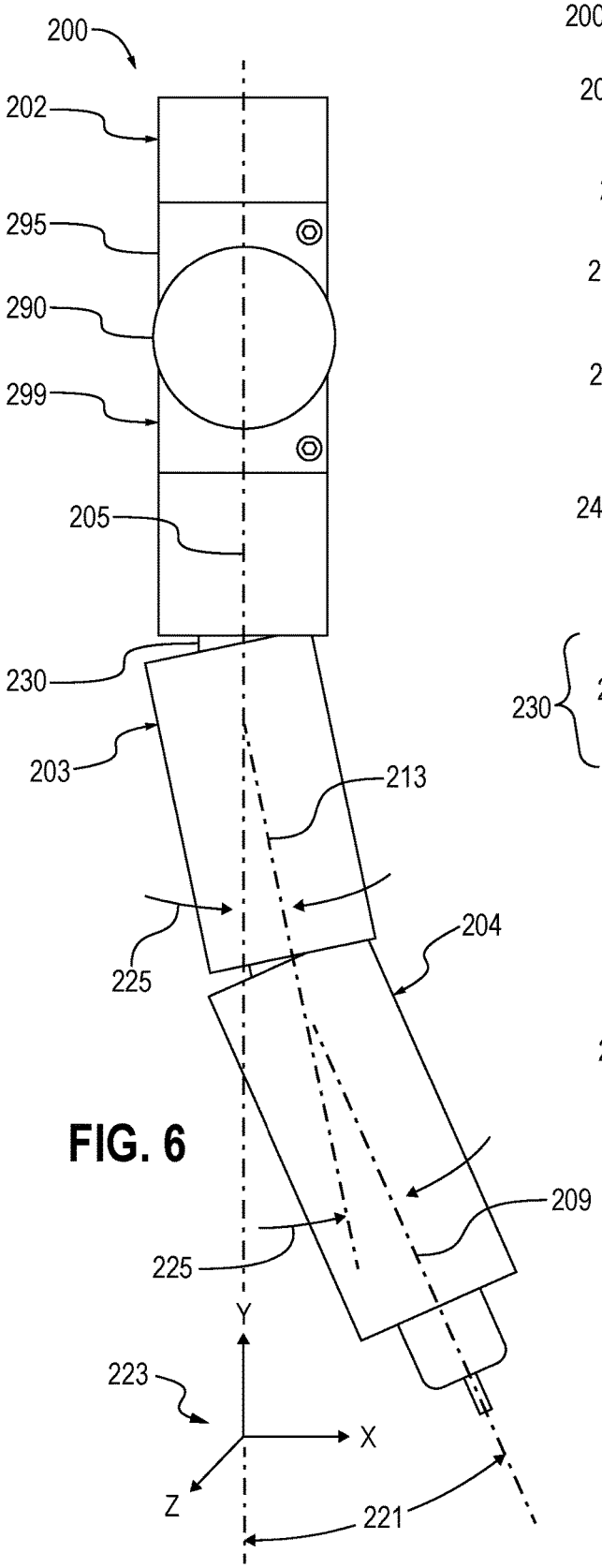
FIG. 6 is a side view of the apparatus shown in FIG. 2 in an operational position.

FIGS. 6 and 7 are side and sectional side views, respectively, of the joint tool 200 shown in FIGS. 2 and 3, at a different operational position. The following description refers to FIGS. 1-7, collectively.

As described above, a tool string 110 may comprise one or more of the joint tools 200 coupled with, between, and/or on opposing sides of portions (e.g., downhole tools 112) of the tool string. Each joint tool 200 may be operable to flexibly or otherwise movably connect adjacent portions (e.g., downhole tools 112) of the tool string 110 coupled with the joint tool 200 to permit bending of the tool string 110 and, thus, permit, help, or otherwise facilitate conveyance of the tool string 110 past or through shear offsets, lateral shifts, doglegs, and other deviations having tight bends 107 along the wellbore 102.

Each joint tool 200 coupled along the tool string 110 may permit or otherwise facilitate relative angular movement (i.e., bending) between adjacent portions of the tool string 110 coupled with the joint tool 200 as the tool string 110 is conveyed through bends 107 along the wellbore 102. For example, the movable joints 230, 232 may collectively facilitate relative angular movement between the upper sub 202 and the lower sub 204 from a first position in which the central axis 205 of the upper sub 202 and the central axis 209 of the lower sub 204 are substantially axially aligned, as shown in FIGS. 2 and 3, to a second position in which the central axis 205 of the upper sub 202 and the central axis 209 of the lower sub 204 are positioned at a relative angle 221, as shown in FIGS. 6 and 7. Each movable joint 230, 232 may permit a corresponding one of the intermediate sub 203 and lower sub 204 to move (bend) by a predetermined incremental angle 225, thereby collectively permitting the upper sub 202 and the lower sub 204 and, thus, the adjacent portions of the tool string 110 coupled with the joint tool 200, to move (bend) with respect to each other by the cumulative angle 221. Aligning the central axis 205 of the upper sub 202 with a Y-axis of a Cartesian coordinate system 223, the central axis 209 of the lower sub 204 can extend in any radial direction from the Y axis (along the X-Z plane) at the angle 221.

As described above, the joint tool 200 may comprise a plurality of biasing members 262, 264, each disposed in association with a corresponding movable joint 230, 232. Each biasing member 262, 264 may be operable to bias angular movement of a corresponding one of the movable joints 230, 232 such that the central axis 205 of the upper sub 202 and the central axis 209 of the lower sub 204 are substantially axially aligned. During downhole conveyance while the joint tool 200 passes through bends 107 along the wellbore 102, each movable joint 230, 232 may bend such that each socket 238, 242 and corresponding sub 203, 204 is at an angle (e.g., the angle 225) with respect to a corresponding ball member 236, 240 and rod 244, 254. While each movable joint 230, 232 is bent, relative angular movement between each ball member 236, 240 and socket 238, 242 causes relative angular movement between the face 272 of the ball member 236, 240 and the face of the ring 274, 284. Such movement causes an edge on one side of the face 272, 282 to extend toward and move a corresponding ring 274, 284 along the cavity 248, 258 and, thus, compress a corresponding biasing member 262, 264. Because the biasing force of each biasing member 262, 264 is applied to the ball member 236, 240 on one side of the ball member 236, 240, each biasing member 262, 264 generates a torque that urges relative angular movement of a corresponding ball member 236, 240 and socket 238, 242 to positions in which the central axis 205 of the upper sub 202 and the central axis 209 of the lower sub 204 are substantially axially aligned. Thus, during downhole conveyance after the joint tool 200 passes through a bend 107 along the wellbore 102, the subs 202, 203, 204 of the joint tool 200 may automatically spring back to a substantially straight configuration in which the central axes 205, 213, 209 are substantially axially aligned, as shown in FIGS. 2 and 3.

Figure 8:
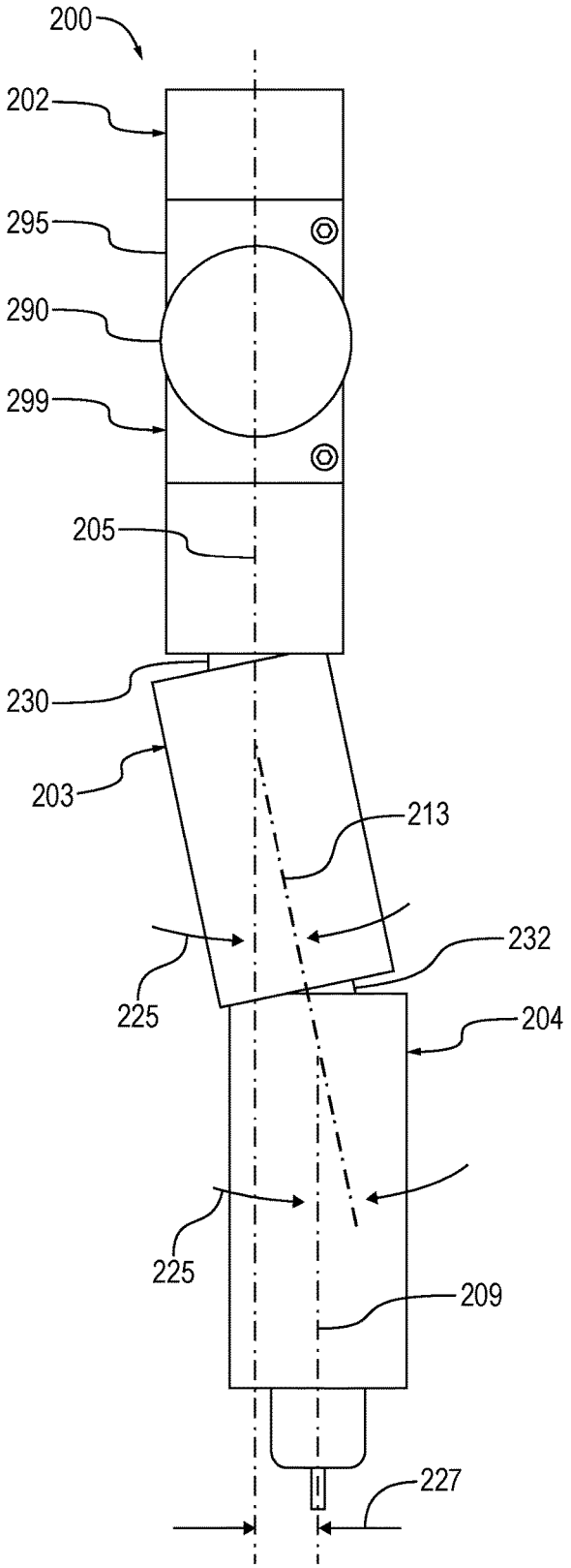
FIG. 8 is a side view of the apparatus shown in FIG. 2 in a different operational position.

FIGS. 8 and 9 are side and sectional side views, respectively, of the joint tool 200 shown in FIGS. 2, 3, 6, and 7, at a different operational position. The following description refers to FIGS. 1-9, collectively.

The joint tool 200 coupled along the tool string 110 may permit or otherwise facilitate relative angular movement between adjacent portions of the tool string 110 coupled with the joint tool 200 as the tool string 110 is conveyed through bends 107 along the wellbore 102. For example, the movable joints 230, 232 may collectively facilitate relative lateral movement between the upper sub 202 and the lower sub 204 from a first position in which the central axis 205 of the upper sub 202 and the central axis 209 of the lower sub 204 are substantially axially aligned, as shown in FIGS. 2 and 3, to a second position in which the central axis 205 of the upper sub 202 and the central axis 209 of the lower sub 204 are laterally offset by a lateral distance 227, as shown in FIGS. 8 and 9. In the laterally offset position of the joint tool 200, the central axis 205 of the upper sub 202 and the central axis 209 of the lower sub 204 may be or remain substantially parallel. Substantially parallel may comprise a range between fully parallel (i.e., zero degrees difference) and almost fully parallel (e.g., a difference of five degrees or less). Each movable joint 230, 232 may permit a corresponding one of the intermediate sub 203 and lower sub 204 to move (i.e., bend) by a predetermined incremental angle 225 in opposing directions, thereby collectively permitting the upper sub 202 and the lower sub 204 and, thus, the adjacent portions of the tool string 110 coupled with the joint tool 200, to move laterally with respect to each other by the lateral distance 227.

As described above, the joint tool 200 may comprise a plurality of biasing members 262, 264, each disposed in association with a corresponding movable joint 230, 232. Each biasing member 262, 264 may be operable to bias angular movement of a corresponding one of the movable joints 230, 232 such that the central axis 205 of the upper sub 202 and the central axis 209 of the lower sub 204 are substantially axially aligned. During downhole conveyance while the joint tool 200 passes through bends 107 along the wellbore 102, each movable joint 230, 232 may bend in opposing directions such that each socket 238, 242 and corresponding sub 203, 204 is at an angle (i.e., angle 225) with respect to a corresponding ball member 236, 240 and rod 244, 254. Thus, during downhole conveyance, the upper sub 202 and the lower sub 204 may move laterally with respect to each other while their central axes 205, 209 are able to remain substantially parallel. After the joint tool 200 passes through the bend 107 along the wellbore 102, the subs 202, 203, 204 of the joint tool 200 may automatically spring back to a substantially straight configuration in which the central axes 205, 213, 209 are substantially axially aligned, as shown in FIGS. 2 and 3.

Figure 10:
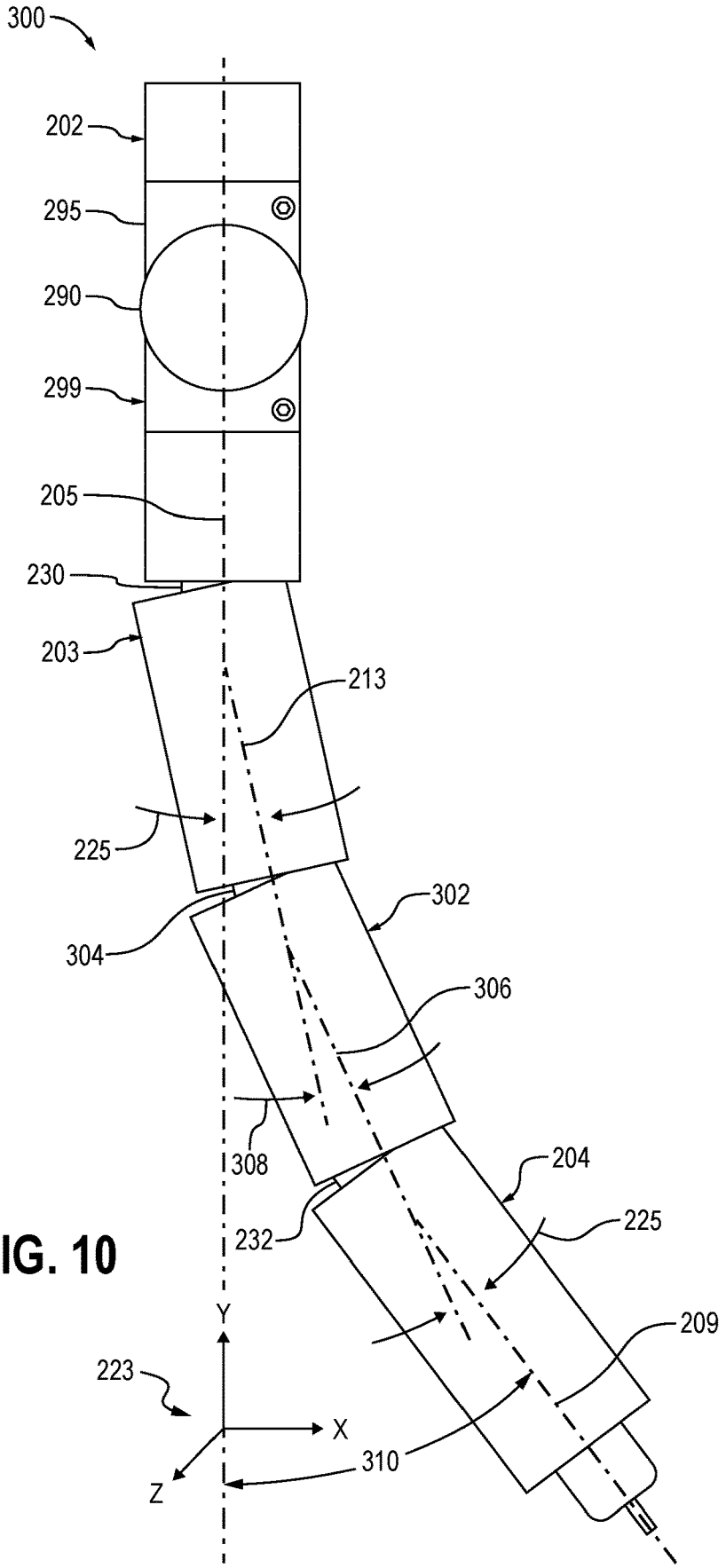
FIG. 10 is a side view of at least a portion of an example implementation of apparatus according to one or more aspects of the present disclosure in an operational position.
Figure 11:
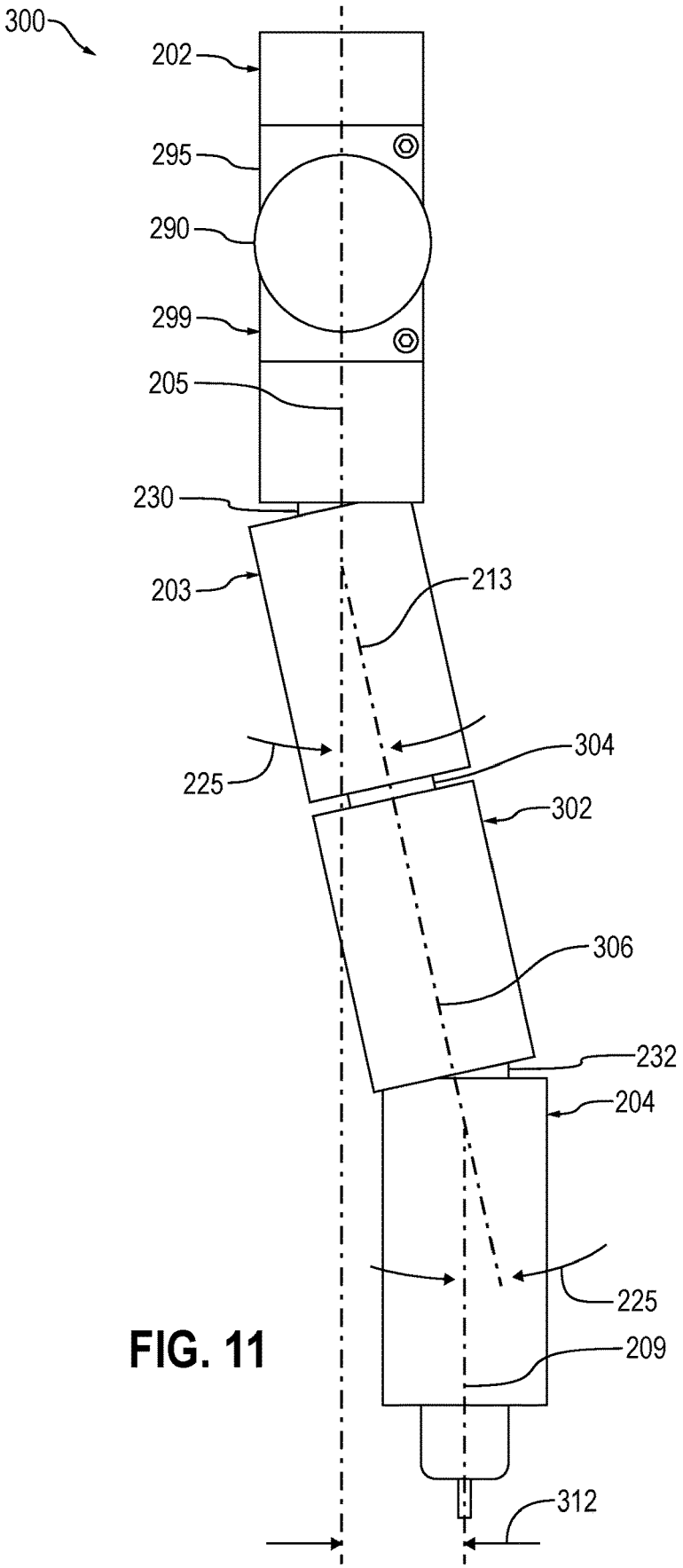
FIG. 11 is a side view of the apparatus shown in FIG. 10 in an operational position.

A joint tool according to one or more aspects of the present disclosure may comprise additional movable joints to permit the upper sub 202 and the lower sub 204 and, thus, the adjacent portions of the tool string 110 coupled with the joint tool, to move with respect to each other by a larger cumulative angle and/or lateral distance. FIGS. 10 and 11 are side views of an example implementation of a joint tool 300 according to one or more aspects of the present disclosure. The joint tool 300 may be coupled within or along a tool string 110 and may comprise one or more features and/or modes of operation of the joint tool 200 described above and shown in FIGS. 2-9, including where indicated by the same reference numerals. The following description refers to FIGS. 1-11, collectively.

The joint tool 300 may comprise another intermediate sub 302 connected between the intermediate sub 203 and the lower sub 204 via another movable joint 304. The intermediate sub 302 may comprise one or more features and/or modes of operation of the intermediate sub 203 described above, and the movable joint 304 may comprise one or more features and/or modes of operation of the movable joints 230, 232 described above. Thus, the intermediate sub 203 may be movably connected with the intermediate sub 302 via the movable joint 304 in the same manner as the intermediate sub 203 is connected to the lower sub 204 in the joint tool 200.

The joint tool 300 coupled along the tool string 110 may permit or otherwise facilitate relative angular movement between adjacent portions of the tool string 110 coupled with the joint tool 300 in a similar manner as the joint tool 200 as the tool string 110 is conveyed through bends 107 along the wellbore 102. As shown in FIG. 10, the movable joint 304 may permit a central axis 306 of the intermediate sub 302 to move by a predetermined incremental angle 308 with respect to the central axis 213 of the intermediate sub 203, thereby collectively permitting the upper sub 202 and the lower sub 204 and, thus, the adjacent portions of the tool string 110 coupled with the joint tool 200, to move with respect to each other by the cumulative angle 310, which can be larger than the cumulative angle 221.

The joint tool 300 coupled along the tool string 110 may also permit or otherwise facilitate relative lateral movement between adjacent portions of the tool string 110 coupled with the joint tool 300 in a similar manner as the joint tool 200 as the tool string 110 is conveyed through bends 107 along the wellbore 102. As shown in FIG. 11, the intermediate sub 302 may extend laterally in the same direction as the intermediate sub 203, thereby moving the lower sub 204 further in the lateral direction. Each movable joint 230, 232 may permit a corresponding one of the intermediate sub 203 and lower sub 204 to move (i.e., bend) by a predetermined incremental angle 225 in opposing directions, thereby collectively permitting the upper sub 202 and the lower sub 204 and, thus, the adjacent portions of the tool string 110 coupled with the joint tool 200, to move laterally with respect to each other by a lateral distance 312, which can be larger than the lateral distance 227. In the laterally offset position of the joint tool 300, the central axis 205 of the upper sub 202 and the central axis 209 of the lower sub 204 may be or remain substantially parallel.

Although FIGS. 2-9 show the joint tool 200 comprising one intermediate sub 203 and two movable joints 230, 232, and FIGS. 10 and 11 show the joint tool 300 comprising two intermediate subs 203, 302 and three movable joints 230, 232, 304, it is to be understood that a joint tool according to one or more aspects of the present disclosure may comprise three, four, or more intermediate subs and four, five, or more movable joints to permit the upper sub 202 and the lower sub 204 and, thus, the adjacent portions of the tool string 110 coupled with the joint tools to move with respect to each other by still larger cumulative angles and lateral distances.

Figure 12:
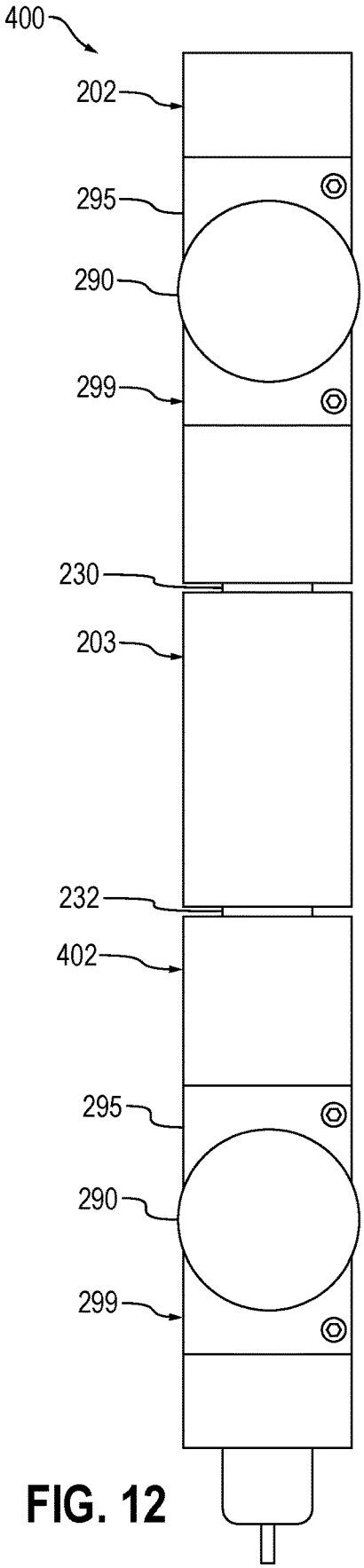
FIG. 12 is a side view of at least a portion of an example implementation of apparatus according to one or more aspects of the present disclosure.

FIG. 12 is a side view of an example implementation of a joint tool 400 according to one or more aspects of the present disclosure. The joint tool 400 may be coupled within or along a tool string 110 and may comprise one or more features and/or modes of operation of the joint tools 200, 300 described above and shown in FIGS. 2-11, including where indicated by the same reference numerals. The following description refers to FIGS. 1 and 12, collectively.

The joint tool 400 may comprise sets of rotatable members 290 connected at opposing upper and lower ends of the joint tool 400. For example, the joint tool 400 may comprise an upper roller/clamp assembly 299 connected to or forming a portion of an upper sub 202 and a lower roller/clamp assembly 299 connected to or forming a portion of a lower sub 402. The lower sub 402 may comprise one or more features and/or modes of operation of both the upper sub 202 and the lower sub 204 of the joint tool 200. For example, the lower sub 402 may comprise structure of the lower sub 204 and also comprise a mandrel 215 and shoulders 217, 219 of the upper sub 202, such as may permit the roller/clamp assembly 299 to be connected to the lower sub 402.

Figure 13:
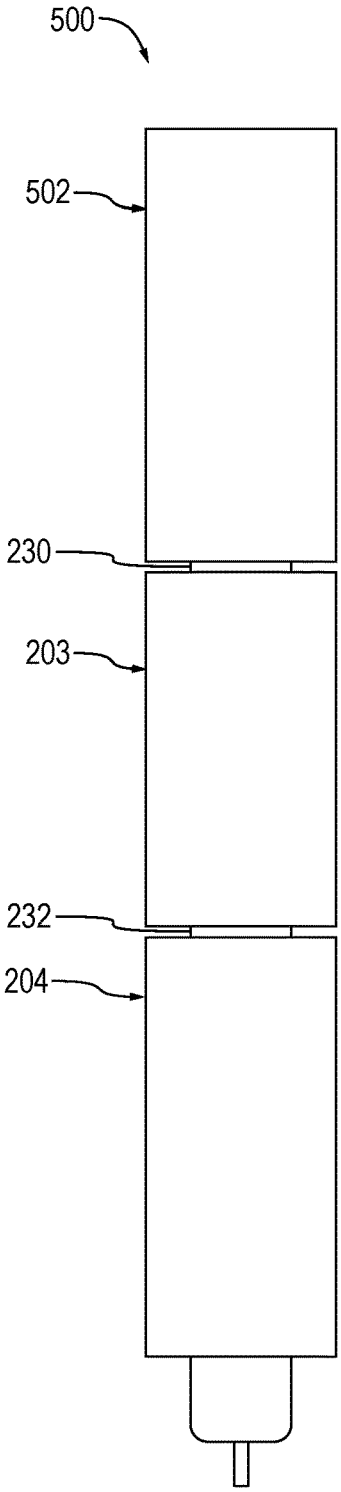
FIG. 13 is a side view of at least a portion of an example implementation of apparatus according to one or more aspects of the present disclosure.

FIG. 13 is a side views of an example implementation of a joint tool 500 according to one or more aspects of the present disclosure. The joint tool 500 may be coupled within or along a tool string 110 and may comprise one or more features and/or modes of operation of the joint tools 200, 300 described above and shown in FIGS. 2-11, including where indicated by the same reference numerals. The following description refers to FIGS. 1 and 13, collectively.

The joint tool 500 may be implemented without or otherwise not comprise any rotatable members 290. For example, the joint tool 500 may comprise an upper sub 502 that does not comprise a roller/clamp assembly 299 connected thereto. The upper sub 502 may comprise one or more features and/or modes of operation of both the upper sub 202 of the joint tool 200, except that the upper sub 502 may not comprise a mandrel 215 and shoulders 217, 219 for connecting the roller/clamp assembly 299.

Although FIGS. 12 and 13 show the joint tools 400, 500, respectively, comprising one intermediate sub 203 and two movable joints 230, 232, it is to be understood that the joint tools 400, 500 may each comprise two, three, four, or more intermediate subs and three, four, five, or more movable joints to permit the upper sub 202, 502 and the lower sub 204, 402 and, thus, the adjacent portions of the tool string 110 coupled with the joint tools 400, 500, to move with respect to each other by larger cumulative angles and lateral distances.

Figure 14:
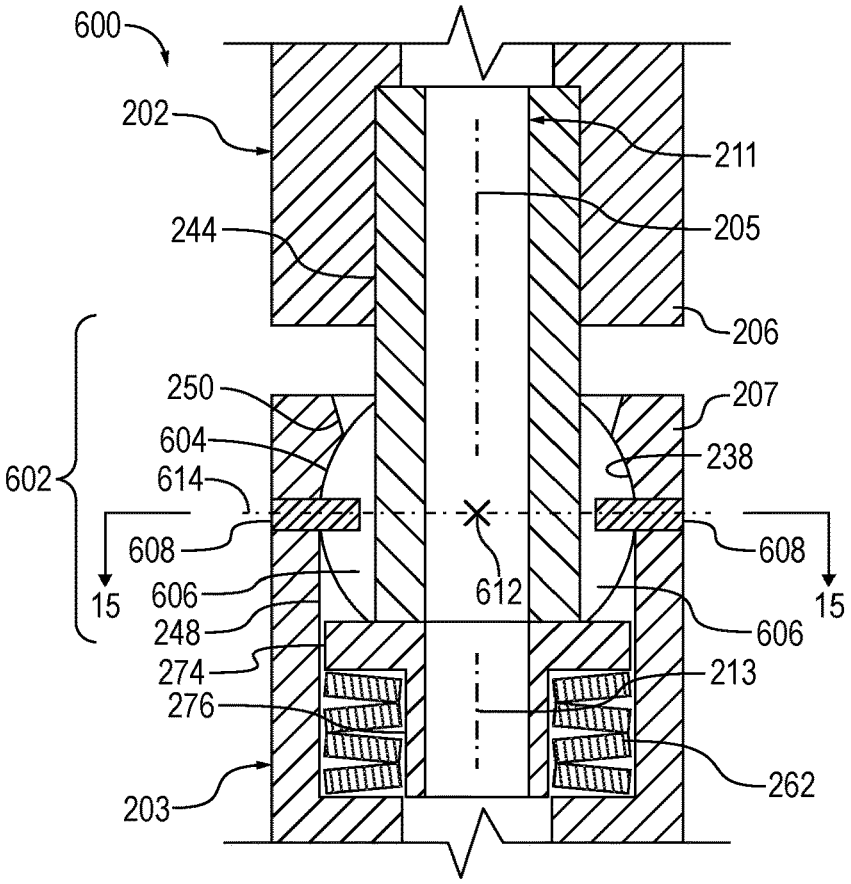
FIG. 14 is a sectional side view of a portion of an example implementation of apparatus according to one or more aspects of the present disclosure.
Figure 15:
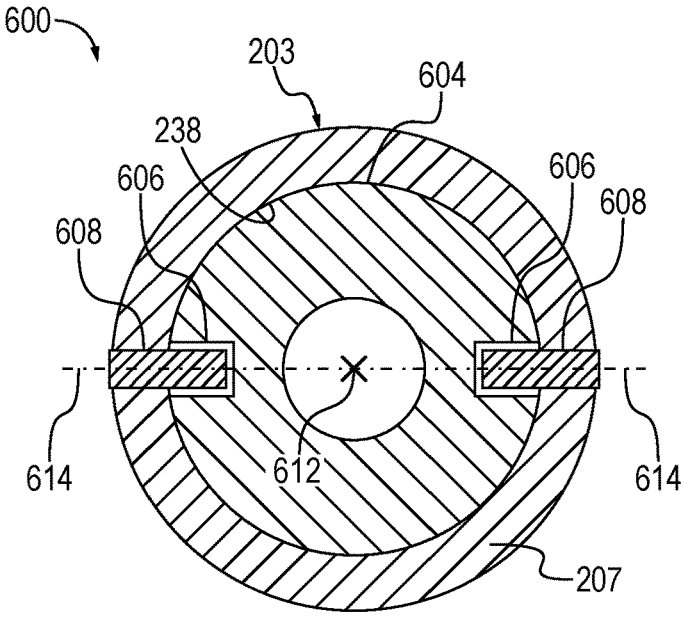
FIG. 15 is a sectional axial view of a portion of the apparatus shown in FIG. 14.
Figure 16:
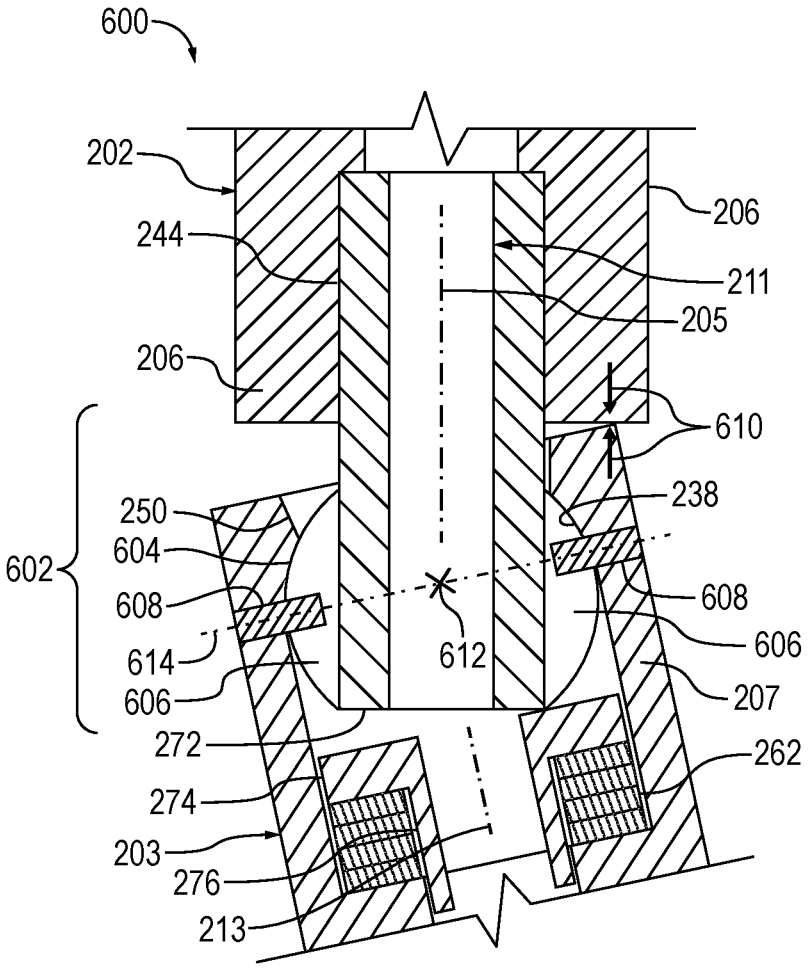
FIG. 16 is a sectional side view of the apparatus shown in FIG. 14 in an operational position.

FIGS. 14 and 15 are sectional side and sectional axial views, respectively, of a portion of an example implementation of a joint tool 600 according to one or more aspects of the present disclosure. FIG. 16 is a sectional side view of the portion of the joint tool 600 shown in FIG. 14, at a different operational position. The joint tool 600 may be coupled within or along a tool string 110 and may comprise one or more features and/or modes of operation of the joint tools 200, 300, 400, 500 described above and shown in FIGS. 2-13, including where indicated by the same reference numerals. The joint tool 600 may comprise a plurality of movable joints 602 instead of the movable joints 230, 232, 304 described above. Although the movable joints 602 are shown implemented as part of the joint tool 600, is to be understood that the movable joints 602 may be implemented as part of the joint tools 200, 300, 400, 500 instead of the movable joints 230, 232, 304. The joint tool 600 is shown without the electrical conductor 218 for clarity and ease of understanding. The following description refers to FIGS. 1-16, collectively.

Similarly to the movable joints 230, 232, 304, the movable joints 602 may facilitate limited relative angular movement between adjacent subs 202, 203, 204 of the joint tool 600 and, thus, collectively facilitate limited relative angular movement between a portion of the tool string 110 connected above the joint tool 600 and a portion of the tool string 110 connected below the joint tool 600. However, the movable joints 602 may also prevent or inhibit relative axial rotation between the adjacent subs 202, 203, 204 about their respective central axes 205, 213, 209 to prevent or inhibit relative axial rotation between the upper sub 202 and the lower sub 204 about their respective central axes 205, 209. The movable joints 602 may thus prevent or inhibit relative axial rotation between portions of the tool string 110 connected above and below the joint tool 600 about their respective central longitudinal axes. Accordingly, the movable joints 602 may facilitate transfer of torque between each adjacent sub 202, 203, 204 to facilitate transfer of torque between the upper sub 202 and the lower sub 204 to thereby facilitate transfer of torque between portions of the tool string 110 connected above and below the joint tool 600.

Each movable joint 602 may comprise a ball member 604 having one or more (e.g., two) channels 606 extending along an outer surface the ball member 604. Each channel 606 may extend radially inward into the ball member 604 and axially (longitudinally) along the ball member 604 parallel to the central axis 205, 213 of the sub 202, 203 to which the ball member 604 is fixedly connected to via the rod 244, 254. Each movable joint 602 may further comprise one or more (e.g., two) protruding members 608 (e.g., pins) fixedly connected with the socket member 238, 242 (or other portion of the body 207, 208) and extending radially inward into the cavity 248, 258 of the socket member 238, 242 such that each protruding member 608 is disposed within a corresponding channel 606 of the ball member 604. Each protruding member 608 may have an outer diameter that is slightly smaller than a width of each channel 606 or otherwise be sized to fit within and slide along a corresponding channel 606. Each protruding member 608 may be aligned with a center 612 of a corresponding ball member 604, whereby the center 612 of the ball member 604 is located directly between the protruding members 608. For example, if the protruding members 608 are or comprise pins each fixedly connected with the socket member 238, 242 and having a central longitudinal axis 614, then the central longitudinal axes 614 of the protruding members 608 extend through the center 612 of the ball member 604. Such alignment between the protruding members 608 and the ball member 604 permits relative angular movement between adjacent subs 202, 203, 204 in every circumferential (i.e., azimuthal) direction.

During downhole conveyance, a torque imparted to one or more of the subs 202, 203, 204 will cause the protruding members 608 to contact sidewalls (or edges) of the channels 606 to thereby maintain the protruding members 608 within the channels 606. The movable joints 602 may thus prevent or inhibit relative axial rotation between the ball members 604 and the corresponding socket members 238, 242 (and other portions of the bodies 207, 208) about their respective central axes 205, 213, 209 to thereby prevent or inhibit relative axial rotation between the subs 202, 203, 204 about their respective central axes 205, 213, 209. The movable joints 602 may thus collectively prevent or inhibit relative axial rotation between the upper sub 202 and the lower sub 204 to thereby prevent or inhibit relative axial rotation between portions of the tool string 110 connected above and below the joint tool 600 about their respective central axes, such as to maintain an intended relative rotational alignment between predetermined downhole tools 112 connected above and below the joint tool 600. The movable joints 602 may thus facilitate transfer of torque between the upper and lower portions of the tool string 110 connected above and below the joint tool 600.

The range of angular movement between adjacent subs 202, 203, 204 may be limited to a predetermined angle controlled by, for example, the size (e.g., inner diameter) of the axial opening 250, 260, the size (e.g., outer diameter) of the rod 244, 254, the size (e.g., outer diameter) of the bodies 206, 207, 208 of the adjacent subs 202, 203, 204, and relative positioning (e.g., distance) between the bodies 206, 207, 208 of the adjacent subs 202, 203, 204. For example, contact between the rod 244, 254 and a sidewall of the axial opening 250, 260 and contact between edges or other outer surfaces of adjacent bodies 206, 207, 208 may limit the range of angular movement between adjacent subs 202, 203, 204.

As shown in FIG. 16, during downhole conveyance while the joint tool 600 passes through the bends 107 along the wellbore 102, each movable joint 602 may experience bending forces causing relative angular movement between each ball member 604 and a corresponding socket member 238, 242 (and other portions of the body 207, 208) causing each protruding member 608 to move along a corresponding channel 606. As described above, the bending forces may facilitate relative angular movement of the adjacent subs 202, 203, 204 between a first relative angular position in which the central axes 205, 213, 209 of the adjacent subs 202, 203, 204 are axially aligned (as shown in FIG. 14) and a second relative angular position in which the central axes 205, 213, 209 of the adjacent subs 202, 203, 204 are positioned at a relative angle (as shown in FIG. 16). The relative angular movement may be caused to stop at the second relative angular position when the rod 244, 254 contacts a sidewall of the body 207, 208 defining the axial opening 250, 260 and/or when adjacent bodies 206, 207, 208 contact each other.

Figure 19:
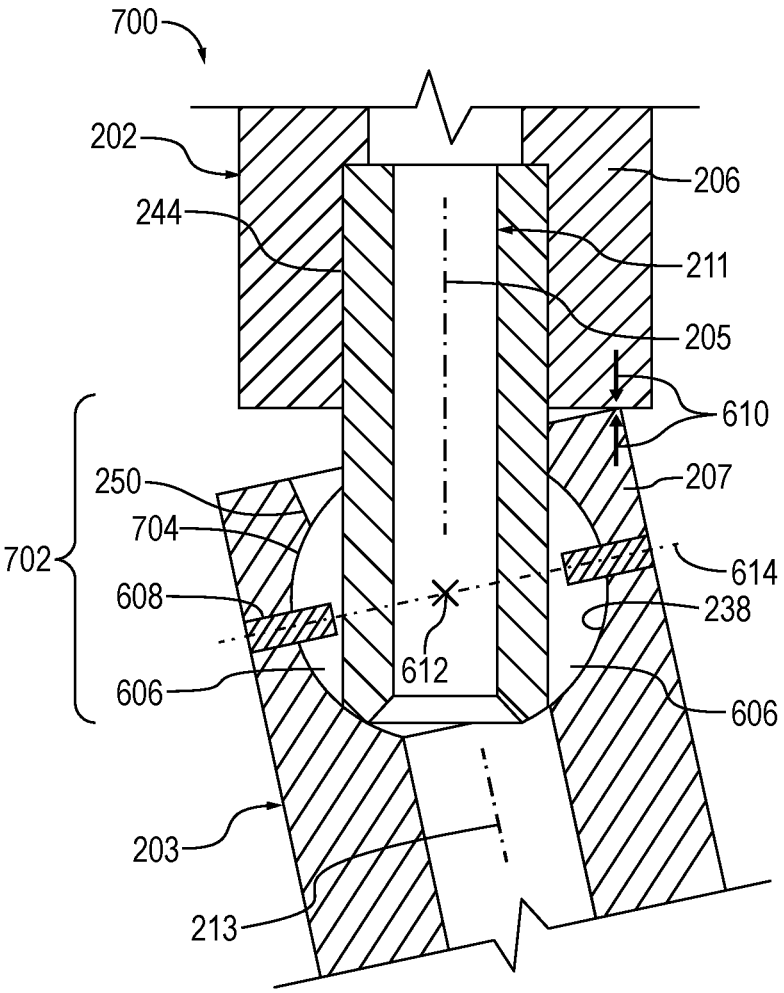
FIG. 19 is a sectional side view of the apparatus shown in FIG. 17 in an operational position.

Accordingly, the joint tool 600 may be configured such that edges or other outer surfaces of the adjacent bodies 206, 207, 208 contact each other before the rod 244, 254 contacts the sidewall of the axial opening 250, 260 (as shown in FIG. 16). The joint tool 600 may instead be configured such that edges or other outer surfaces of the adjacent bodies 206, 207, 208 contact each other at the same time the rods 244, 254 contact the sidewall of the axial openings 250, 260 (as shown in FIG. 19). When the adjacent bodies 206, 207, 208 contact each other, the moment of inertia of structural members (e.g., the rods 244, 254) connecting the subs 202, 203, 204 is increased, resulting in the bending forces (tension and compression forces) between the subs 202, 203, 204 being distributed over a larger (or wider) area, thereby reducing the bending forces and associated stresses experienced by the rods 244, 254. In other words, the bending forces imparted to movable joints 602 may be at least partially transmitted to the contacting bodies 206, 207, 208 in the form of compression forces 610. Such configuration may reduce or eliminate compression forces imparted to the rods 244, 254 on the side of the rods 244, 254 closest to the contacting bodies 206, 207, 208, thereby reducing bending forces imparted to the rods 244, 254. Such configuration may thus reduce or eliminate bending of the rods 244, 254 while the joint tool 600 passes through the bends 107 along the wellbore 102. As described above, when the joint tool 600 moves past the bends 107 along the wellbore 102, the biasing members 262, 264 may bias or otherwise urge movement of the movable joints 602 to a position in which the central axes 205, 213, 209 of the subs 202, 203, 204 are substantially axially aligned.

Figure 17:
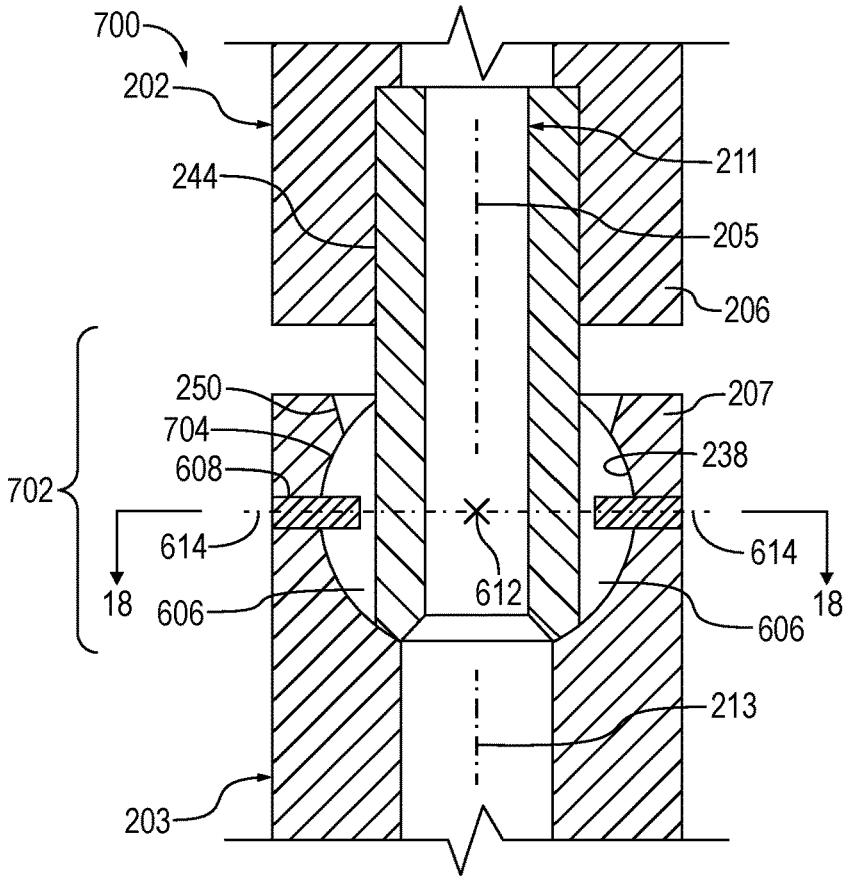
FIG. 17 is a sectional side view of a portion of an example implementation of apparatus according to one or more aspects of the present disclosure.
Figure 18:
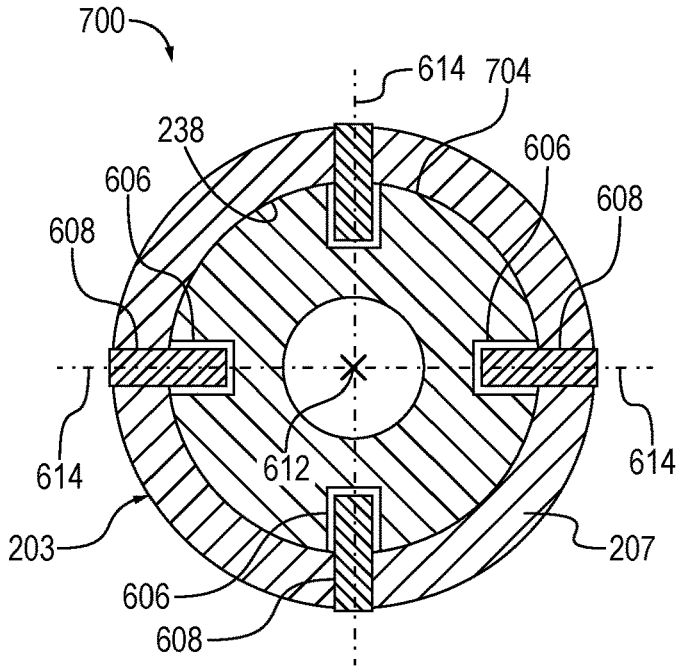
FIG. 18 is a sectional axial view of a portion of the apparatus shown in FIG. 17.

FIGS. 17 and 18 are sectional side and sectional axial views, respectively, of a portion of an example implementation of a joint tool 700 according to one or more aspects of the present disclosure. FIG. 19 is a sectional side view of the portion of the joint tool 700 shown in FIG. 17, at a different operational position. The joint tool 700 may be coupled within or along a tool string 110 and may comprise one or more features and/or modes of operation of the joint tools 200, 300, 400, 500, 600 described above and shown in FIGS. 2-16, including where indicated by the same reference numerals. The joint tool 700 may comprise a plurality of movable joints 702 instead of the movable joints 230, 232, 304, 602 described above. Although the movable joints 702 are shown implemented as part of the joint tool 700, is to be understood that the movable joints 702 may be implemented as part of the joint tools 200, 300, 400, 500, 600 instead of the movable joints 230, 232, 304, 602. The joint tool 700 is shown without the electrical conductor 218 for clarity and ease of understanding. The following description refers to FIGS. 1-19, collectively.

Similarly to the movable joints 230, 232, 304, 602 the movable joints 702 may facilitate limited relative angular movement between adjacent subs 202, 203, 204 of the joint tool 700 and, thus, collectively facilitate limited relative angular movement between a portion of the tool string 110 connected above the joint tool 700 and a portion of the tool string 110 connected below the joint tool 700. However, the movable joints 702 may also prevent or inhibit relative axial rotation between the adjacent subs 202, 203, 204 about their respective central axes 205, 213, 209 to prevent or inhibit relative axial rotation between the upper sub 202 and the lower sub 204 about their respective central axes 205, 209. The movable joints 702 may thus prevent or inhibit relative axial rotation between portions of the tool string 110 connected above and below the joint tool 700 about their respective central longitudinal axes. Accordingly, the movable joints 702 may facilitate transfer of torque between each adjacent sub 202, 203, 204 to facilitate transfer of torque between the upper sub 202 and the lower sub 204 to thereby facilitate transfer of torque between portions of the tool string 110 connected above and below the joint tool 700.

Each movable joint 702 may comprise a ball member 704 having one or more (e.g., four) channels 606 extending along an outer surface the ball member 704. Each channel 606 may extend radially inward into the ball member 704 and axially (longitudinally) along the ball member 704 parallel to the central axis 205, 213 of the sub 202, 203 to which the ball member 704 is fixedly connected to via the rod 244, 254. Each movable joint 702 may further comprise one or more (e.g., four) protruding members 608 (e.g., pins) fixedly connected with the socket member 238, 242 (or other portion of the body 207, 208) and extending radially inward into the cavity 248, 258 of the socket member 238, 242 such that each protruding member 608 is disposed within a corresponding channel 606 of the ball member 704. Each protruding member 608 may have an outer diameter that is slightly smaller than a width of each channel 606 or otherwise be sized to fit within and slide along a corresponding channel 606. Each protruding member 608 may be aligned with a center 612 of a corresponding ball member 704, whereby the center 612 of the ball member 704 is located directly between the protruding members 608. For example, if the protruding members 608 are or comprise pins each fixedly connected with the socket member 238, 242 and having a central longitudinal axis 614, then the central longitudinal axes 614 of the protruding members 608 extend through the center 612 of the ball member 704. Such alignment between the protruding members 608 and the ball member 704 permits relative angular movement between adjacent subs 202, 203, 204 in every circumferential (i.e., azimuthal) direction. The joint tool 700 may also be implemented without the biasing members 262, 264 that urge angular movement of the movable joints 702. The socket members 238, 242 containing the ball members 704 may thus extend around the ball members 704 on both upper and lower sides of the ball members 704.

During downhole conveyance, a torque imparted to one or more of the subs 202, 203, 204 will cause the protruding members 608 to contact sidewalls (or edges) of the channels 606 to thereby maintain the protruding members 608 within the channels 606. The movable joints 702 may thus prevent or inhibit relative axial rotation between the ball members 704 and the corresponding socket members 238, 242 (and other portions of the bodies 207, 208) about their respective central axes 205, 213, 209 to thereby prevent or inhibit relative axial rotation between the subs 202, 203, 204 about their respective central axes 205, 213, 209. The movable joints 702 may thus collectively prevent or inhibit relative axial rotation between the upper sub 202 and the lower sub 204 to thereby prevent or inhibit relative axial rotation between portions of the tool string 110 connected above and below the joint tool 700 about their respective central axes 205, 209, such as to maintain an intended relative rotational alignment between predetermined downhole tools 112 connected above and below the joint tool 700. The movable joints 702 may thus facilitate transfer of torque between the upper and lower portions of the tool string 110 connected above and below the joint tool 700.

As shown in FIG. 19, during downhole conveyance while the joint tool 700 passes through the bends 107 along the wellbore 102, each movable joint 702 may experience bending forces causing relative angular movement between each ball member 704 and a corresponding socket member 238, 242 (and other portions of the body 207, 208) causing each protruding member 608 to move along a corresponding channel 606. As described above, the relative angular movement may be caused to stop at the second relative angular position in which the central axes 205, 213, 209 of the adjacent subs 202, 203, 204 are positioned at a relative angle when the rod 244, 254 contacts a sidewall of the body 207, 208 defining the axial opening 250, 260 and/or when adjacent bodies 206, 207, 208 contact each other.

As further shown in FIG. 19, the joint tool 700 may be configured such that edges or other outer surfaces of the adjacent bodies 206, 207, 208 contact each other at the same time the rods 244, 254 contact the sidewall of the axial openings 250, 260. Similarly as described above with respect to the joint tool 600, when the adjacent bodies 206, 207, 208 contact each other, the bending forces imparted to movable joints 702 may be at least partially transmitted to the contacting bodies 206, 207, 208 in the form of compression forces 610. Such configuration may reduce or eliminate compression forces imparted to the rods 244, 254 on the side of the rods 244, 254 closest to the contacting bodies 206, 207, 208, thereby reducing bending forces imparted to the rods 244, 254. Such configuration may thus reduce or eliminate bending of the rods 244, 254 while the joint tool 700 passes through the bends 107 along the wellbore 102. Because the joint tool 700 does not comprise the biasing members 262, 264 in association with the joints 702, the shape of the tool string 110 may be continuously controlled solely by the shape of the wellbore 102 and/or gravity. For example, if the wellbore 102 is curved, the tool string 110 may also be similarly curved. Furthermore, if the tool string 110 is located in a substantially vertical portion of the wellbore, the tool string 110 may be straightened by gravity.

Figure 20:
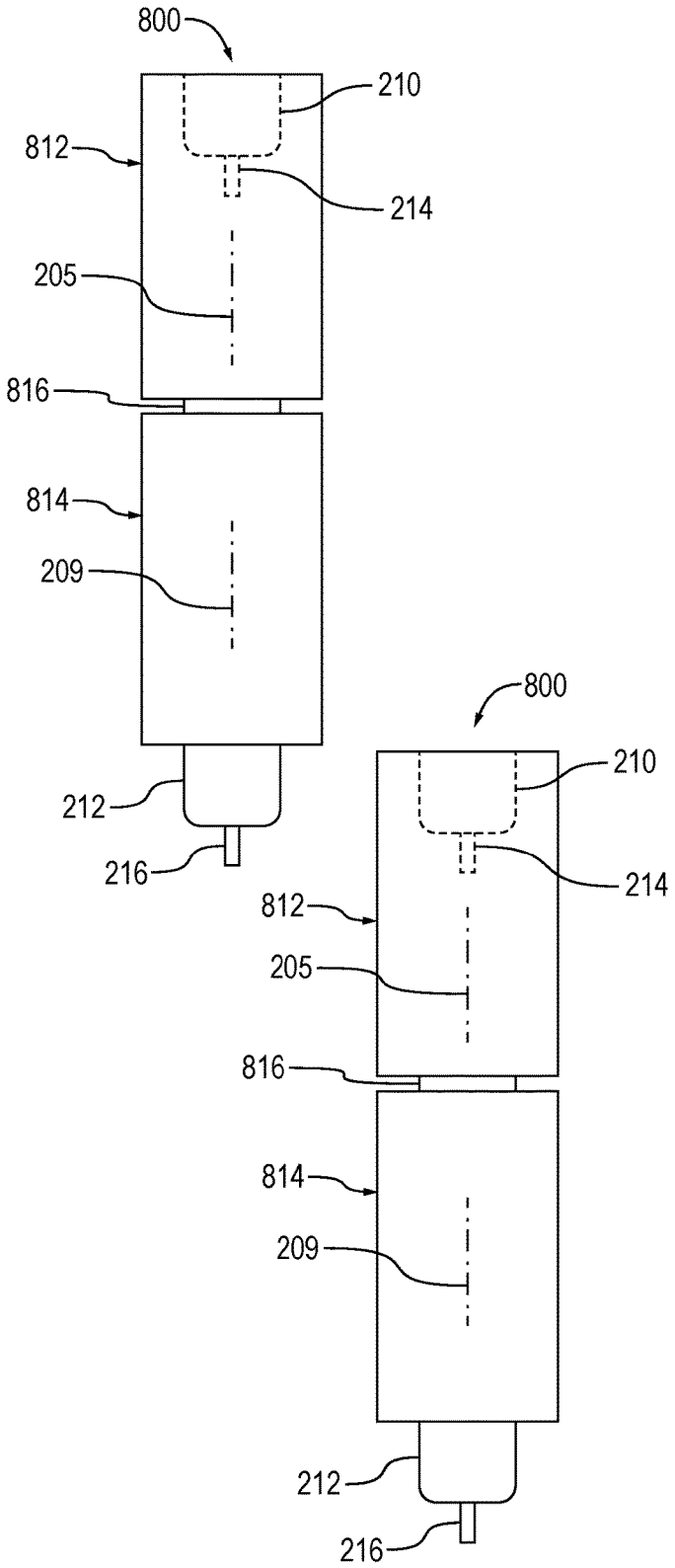
FIG. 20 is a side view of at least a portion of an example implementation of apparatus according to one or more aspects of the present disclosure.

FIG. 20 is a side view of a plurality (or a set) of modular downhole joint tools 800 ("joint tools") according to one or more aspects of the present disclosure. Each joint tool 800 may be coupled within or along a tool string 110 between adjacent downhole tools 112 and facilitate relative angular movement between a first portion of the tool string 110 located above the joint tool 800 and the second portion of the tool string 110 located below the joint tool 800. Each joint tool 800 may comprise one or more features and/or modes of operation of the joint tools 200, 300, 400, 500, 600, 700 described above and shown in FIGS. 2-19, including where indicated by the same reference numerals. Accordingly, the following description refers to FIGS. 1-20, collectively.

An upper end of each joint tool 800 may include an upper sub 812 (e.g., a subassembly or section) for mechanically and/or electrically coupling the joint tool 800 with a corresponding interface (not shown) of a downhole tool 112 of a portion of a tool string 110 located above the joint tool 800. A lower end of each joint tool 800 may include a lower sub 814 (e.g., a subassembly or section) for mechanically and/or electrically coupling the joint tool 800 with a corresponding interface (not shown) of a downhole tool 112 of a portion of the tool string 110 located below the joint tool 800. Each upper sub 812 may comprise one or more features and/or modes of operation of one or more of the upper subs 202, 502 described above, and each lower sub 814 may comprise one or more features and/or modes of operation of one or more of the lower subs 204, 402 described above.

Each upper sub 812 may comprise an upper mechanical interface means 210 (e.g., a mechanical connector, a coupler, a crossover, etc.) for mechanically coupling the joint tool 200 with a corresponding mechanical interface (not shown) of the downhole tool 112 of the portion of the tool string 110 located above the joint tool 800. Each lower sub 814 may comprise a lower mechanical interface means 212 (e.g., a mechanical connector, a coupler, a crossover, etc.) for mechanically coupling the joint tool 800 with a corresponding mechanical interface (not shown) of the downhole tool 112 of the portion of the tool string 110 located below the joint tool 800. Each upper sub 812 may further comprise an upper electrical interface means 214 (e.g., an upper electrical connector) for electrically coupling with a corresponding electrical interface (not shown) of the downhole tool 112 of the portion of the tool string 110 located above the joint tool 800. Each lower sub 814 may further comprise a lower electrical interface means 216 for electrically coupling with a corresponding electrical interface (not shown) of the downhole tool 112 of the portion of the tool string 110 located below the joint tool 800.

Because the upper sub 812 of each joint tool 800 is operable to fixedly or otherwise rigidly connect with the upper portion (e.g., an upper downhole tool 112) of the tool string 110 located above the joint tool 800, the central axis 205 of the upper sub 812 may coincide with and, thus, be considered as the central axis of the upper portion of the tool string 110. Similarly, because the lower sub 814 of each joint tool 800 is operable to fixedly or otherwise rigidly connect with the lower portion (e.g., a lower downhole tool 112) of the tool string 110 located below the joint tool 800, the central axis 209 of the lower sub 814 may coincide with and, thus, be considered as the central axis of the lower portion of the tool string 110.

Each joint tool 800 may further comprise a movable joint 816 connecting together the upper sub 812 and the lower sub 814. The movable joint 816 may comprise one or more features and/or modes of operation of one or more of the movable joints 230, 232, 304, 602, 702 described above. The movable joint 816 may thus facilitate relative angular movement between the upper sub 812 and the lower sub 814 and, thus, facilitate relative angular movement between a portion of the tool string 110 connected above the joint tool 800 and a portion of the tool string 110 connected below the joint tool 800. Accordingly, each joint tool 800 may be operable to facilitate relative angular movement of a first (e.g., upper) portion of the tool string and a second (e.g., lower) portion of the tool string between a first relative angular position in which the central axis 205 of the first portion of the tool string and the central axis 209 of the second portion of the tool string are axially aligned and a second relative angular position in which the central axis 205 of the first portion of the tool string and the central axis 209 of the second portion of the tool string are positioned at a relative angle. Furthermore, if the movable joint 816 is implemented with features (e.g., channels 606, protruding members 608, etc.) of the movable joints 602, 702, the movable joint 816 may also prevent or inhibit relative axial rotation between the upper sub 812 and the lower sub 814 to thereby prevent or inhibit relative axial rotation between the portions of the tool string 110 connected above and below the joint tool 800 about their respective central axes 205, 209.

Figure 21:
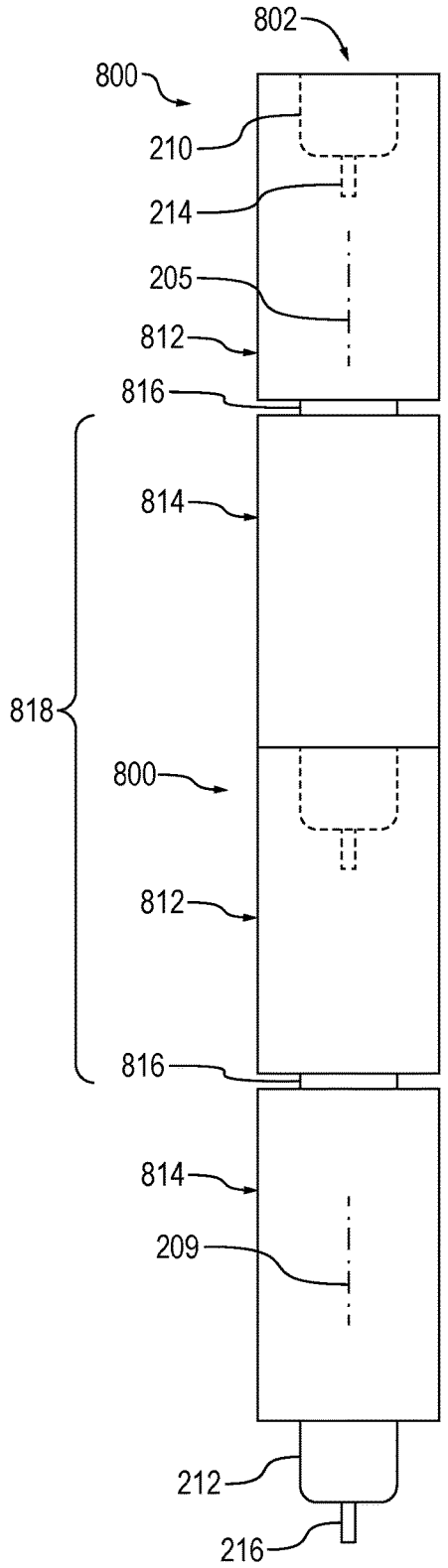
FIG. 21 is a side view of the apparatus shown in FIG. 20 in a different configuration.

The joint tools 800 are also operable to connect together to form a combined downhole joint tool ("combined joint tool"). FIG. 21 is a side view of an example implementation of a combined joint tool 802 comprising the joint tools 800 shown in FIG. 20. The combined joint tool 802 may comprise one or more features and/or modes of operation of the joint tools 200, 300, 400, 500, 600, 700 described above and shown in FIGS. 2-20, including where indicated by the same reference numerals. For example, the combined joint tool 802 may be coupled within or along a tool string 110 between a first portion of the tool string 110 and a second portion of the tool string 110 and facilitate relative angular movement between the first portion of the tool string 110 and the second portion of the tool string 110. Accordingly, the following description refers to FIGS. 1-21, collectively.

To form the combined joint tool 802, the lower sub 814 of a first instance of the joint tools 800 may be fixedly connect with the upper sub 812 of a second instance of the joint tools 800. For example, the lower mechanical interface means 212 and the lower electrical interface means 216 of the first instance of the joint tools 800 may each be connected with the upper mechanical interface means 210 and the upper electrical interface means 214 of the second instance of the joint tools 800 to form the combined joint tool 802. The upper sub 812 of the upper joint tool 800 may thus be or operate as an upper sub 812 of the combined joint tool 802 and the lower sub 814 of the lower joint tool 800 may be or operate as a lower sub 814 of the combined joint tool 802. The connected lower sub 814 of the upper joint tool 800 and the upper sub 812 of the lower joint tool 800 may be or operate as an intermediate sub 818 of the combined joint tool 802. Such intermediate sub 818 may comprise one or more features and/or modes of operation of one or more of the intermediate subs 203 described above.

The combined joint tool 802 may comprise a plurality of subs 812, 814, 818 and movable joints 816 connecting the subs 812, 814, 818, and, thus, operate in a similar manner as the joint tool 200 described above and shown in FIGS. 6 and 7. For example, the combined joint tool 802 may be operable to facilitate relative angular movement of a first (e.g., upper) portion of the tool string 110 and a second (e.g., lower) portion of the tool string 110 between a first relative angular position in which a central axis 205 of the first portion of the tool string 110 and a central axis 209 of the second portion of the tool string 110 are axially aligned and a second relative angular position in which the central axis 205 of the first portion of the tool string 110 and the central axis 209 of the second portion of the tool string 110 are positioned at a relative angle. The combined joint tool 802 may also operate in a similar manner as the joint tool 200 described above and shown in FIGS. 8 and 9. For example, the combined joint tool 802 may be operable to facilitate relative lateral movement of the first portion of the tool string 110 and the second portion of the tool string 110 between a first relative lateral position in which the central axis 205 of the first portion of the tool string 110 and the central axis 209 of the second portion of the tool string 110 are axially aligned and a second relative lateral position in which the central axis 205 of the first portion of the tool string 110 and the central axis 209 of the second portion of the tool string 110 are laterally offset 227 and parallel.

Although FIG. 21 shows a combined joint tool 802 comprising two joint tools 800, it is to be understood that three, four, or more joint tools 800 may be combined to from a combined joint tool operable to be coupled within or along a tool string 110 between a first portion of the tool string 110 and a second portion of the tool string 110 and facilitate relative angular movement between the first portion of the tool string 110 and the second portion of the tool string 110. For example, to form a combined joint tool comprising three joint tools 800, the lower sub 814 of a first instance of the joint tools 800 may be fixedly connect with the upper sub 812 of a second instance of the joint tools 800, and the lower sub 814 of the second instance of the joint tools 800 may be fixedly connect with the upper sub 812 of a third instance of the joint tools 800. Such combined joint tool may comprise four subs (i.e., an upper sub 812, a lower sub 814, and two intermediate subs 818) and three movable joints 816 connecting the four subs, and, thus, operate in a similar manner as the joint tool 300 described above and shown in FIGS. 10 and 11.

In view of the entirety of the present disclosure, a person having ordinary skill in the art will readily recognize that the present disclosure introduces an apparatus comprising a downhole tool operable to connect within a tool string, wherein the downhole tool comprises: a first sub; a second sub; and a movable joint movably connecting the first sub and the second sub to facilitate relative angular movement between the first sub and the second sub, wherein the downhole tool may be operable to connect together a first portion of the tool string and a second portion of the tool string and facilitate relative angular movement between the first portion of the tool string and the second portion of the tool string when the downhole tool is connected within the tool string.

The downhole tool may further comprise a biasing member disposed in association with the movable joint, wherein the biasing member may be operable to urge angular movement of the movable joint toward a relative angular position in which a central axis of the first sub and a central axis of the second sub are axially aligned.

The movable joint may be or comprise a first movable joint, wherein the first sub may be operable to connect with the first portion of the tool string, and wherein the downhole tool may further comprise: a third sub operable to connect with the second portion of the tool string; and a second movable joint movably connecting the second sub and the third sub to facilitate relative angular movement between the second sub and the third sub.

The movable joint may be or comprise a first movable joint, wherein the first sub may be operable to connect with the first portion of the tool string, and wherein the downhole tool may further comprise: a third sub; a fourth sub operable to connect with the second portion of the tool string; a second movable joint movably connecting the second sub and the third sub to facilitate relative angular movement between the second sub and the third sub; and a third movable joint movably connecting the third sub and the fourth sub to facilitate relative angular movement between the third sub and the fourth sub.

The movable joint may comprise a ball member and a socket member.

The movable joint may comprise: a socket member; a ball member disposed within the socket member, wherein the ball member may comprise a plurality of channels each extending along an outer surface of the ball member; and a plurality of protrusions each connected to the socket member and disposed within a corresponding instance of the channels; wherein the movable joint may facilitate relative angular movement of the first sub and the second sub between a first relative angular position in which a first central axis of the first sub and a second central axis of the second sub are axially aligned and a second relative angular position in which the first central axis and the second central axis are positioned at a relative angle; and wherein the movable joint may prevent relative rotation between the first sub about the first axis and the second sub about the second axis.

The movable joint may comprise a ball member and a socket member, wherein the downhole tool may further comprise a biasing member disposed in association with the movable joint, and wherein the biasing member may be operable to urge relative angular movement between the ball member and the socket member toward a relative angular position in which a central axis of the first sub and a central axis of the second sub are axially aligned.

The first sub may comprise a first outer body; wherein the second sub may comprise a second outer body; wherein the movable joint may further comprise a rod extending between the first sub and the second sub; wherein the movable joint facilitates relative angular movement of the first sub and the second sub between a first relative angular position in which a first central axis of the first sub and a second central axis of the second sub are axially aligned and a second relative angular position in which the first central axis and the second central axis are positioned at a relative angle; and wherein the first outer body and the second outer body may be configured to contact when the first sub and the second sub are in the second relative angular position to reduce bending force imparted to the rod.

The downhole tool may be an instance of a plurality of downhole tools each operable to connect within the tool string; wherein each of the downhole tools may be further operable to connect with another of the downhole tools to form a combined downhole tool operable to connect within the tool string; and wherein when the downhole tool is connected within the tool string, the combined downhole tool may be operable to: connect together the first portion of the tool string and the second portion of the tool string; facilitate relative angular movement of the first portion of the tool string and the second portion of the tool string between a first relative angular position in which a central axis of the first portion of the tool string and a central axis of the second portion of the tool string are axially aligned and a second relative angular position in which the central axis of the first portion of the tool string and the central axis of the second portion of the tool string are positioned at a relative angle; and facilitate relative lateral movement of the first portion of the tool string and the second portion of the tool string between a first relative lateral position in which the central axis of the first portion of the tool string and the central axis of the second portion of the tool string are axially aligned and a second relative lateral position in which the central axis of the first portion of the tool string and the central axis of the second portion of the tool string are laterally offset and parallel.

The downhole tool may further comprise a plurality of wheels operable to reduce friction between the downhole tool and a sidewall of a wellbore when the downhole tool is connected within the tool string and the tool string is conveyed within the wellbore.

Each wheel may be operable to rotate about a corresponding axis of rotation, and wherein the wheels may be operable to collectively rotate around a central axis of the downhole tool.

The downhole tool may further comprise a clamp assembly, wherein each of the wheels may be rotatably connected to the clamp assembly, and wherein the clamp assembly may be rotatably connected to the first sub such that the wheels may be operable to collectively rotate around the first sub.

The present disclosure also introduces an apparatus comprising a plurality of downhole tools each comprising: a first sub; a second sub; and a movable joint movably connecting the first sub and the second sub to facilitate relative angular movement between the first sub and the second sub, wherein each of the downhole tools is operable to: connect together a first portion of the tool string and a second portion of the tool string and facilitate relative angular movement between the first portion of the tool string and the second portion of the tool string; and connect with another of the downhole tools to form a combined downhole tool operable to connect together the first portion of the tool string and the second portion of the tool string and facilitate relative angular movement between the first portion of the tool string and the second portion of the tool string.

The downhole tool may be operable to facilitate relative angular movement of the first portion of the tool string and the second portion of the tool string between a first relative angular position in which a central axis of the first portion of the tool string and a central axis of the second portion of the tool string are axially aligned and a second relative angular position in which the central axis of the first portion of the tool string and the central axis of the second portion of the tool string are positioned at a relative angle.

The combined downhole tools may be operable to facilitate relative angular movement of the first portion of the tool string and the second portion of the tool string between a first relative angular position in which a central axis of the first portion of the tool string and a central axis of the second portion of the tool string are axially aligned and a second relative angular position in which the central axis of the first portion of the tool string and the central axis of the second portion of the tool string are positioned at a relative angle; and facilitate relative lateral movement of the first portion of the tool string and the second portion of the tool string between a first relative lateral position in which the central axis of the first portion of the tool string and the central axis of the second portion of the tool string are axially aligned and a second relative lateral position in which the central axis of the first portion of the tool string and the central axis of the second portion of the tool string are laterally offset and parallel.

The second sub of a first instance of the downhole tools may be operable to fixedly connect with the first sub of a second instance of the downhole tools to form the combined downhole tool.

The second sub of a first instance of the downhole tools may be operable to fixedly connect with the first sub of a second instance of the downhole tools and the second sub of the second instance of the downhole tools may be operable to fixedly connect with the first sub of a third instance of the downhole tools to form the combined downhole tool.

The present disclosure also introduces an apparatus comprising a downhole tool operable to connect within a tool string, wherein the downhole tool comprises: a first sub; a second sub; and a movable joint comprising: a socket member; a ball member disposed within the socket member, wherein the ball member comprises a plurality of channels each extending along an outer surface of the ball member; and a plurality of protrusions each connected to the socket member and disposed within a corresponding instance of the channels, wherein the movable joint: connects the first sub and the second sub; facilitates relative angular movement of the first sub and the second sub between a first position in which a first central axis of the first sub and a second central axis of the second sub are axially aligned and a second position in which the first central axis and the second central axis are positioned at a relative angle; and prevents relative rotation between the first sub along the first axis and the second sub along the second axis.

Each of the channels may extend along the outer surface of the ball member parallel to the first central axis.

The protrusions may be aligned with a center of the ball member.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the scope of the present disclosure.

The abstract at the end of this disclosure is provided to permit the reader to quickly ascertain the nature of the technical disclosure. It is submitted with the understanding that it will not be used to interpret or limit the scope or meaning of the claims.

What is claimed is:

1. An apparatus comprising:

a downhole tool operable to connect within a tool string, wherein the downhole tool is operable to connect together a first portion of the tool string and a second portion of the tool string and facilitate relative angular movement between the first portion of the tool string and the second portion of the tool string when the downhole tool is connected within the tool string, and wherein the downhole tool comprises:

a first body;

a second body;

a ball member connected to the first body and disposed within the second body, wherein the ball member comprises a first face, and wherein the first face comprises a first flat surface;

a ring disposed within the second body, wherein the ring comprises a second face, and wherein the second face comprises a second flat surface; and a biasing member disposed within the second body, wherein the biasing member is operable to apply a force to the ring to force the second face against the first face to urge relative angular movement of the ball member and the ring to thereby urge relative angular movement of the first body and the second body toward a relative angular position in which a central axis of the first body and a central axis of the second body are axially aligned.

2. The apparatus of claim 1 wherein the biasing member is operable to apply a force to the ring to force the second face against the first face to urge relative angular movement of the ring with respect to the ball member from a first position, in which the first face and the second face are at a relative angle, to a second position, in which the first face and the second face are flush against each other.

3. The apparatus of claim 1 wherein the ball member and the ring each comprise a bore extending therethrough.

4. The apparatus of claim 1 wherein the biasing member comprises a spring.

5. An apparatus comprising:

a downhole tool operable to connect within a tool string, wherein the downhole tool is operable to connect together a first portion of the tool string and a second portion of the tool string and facilitate relative angular movement between the first portion of the tool string and the second portion of the tool string when the downhole tool is connected within the tool string, and wherein the downhole tool comprises:

a first sub;

a second sub;

a movable joint movably connecting together the first sub and the second sub to facilitate relative angular movement between the first sub and the second sub, wherein the movable joint comprises a ball member, wherein the ball member comprises a first face, and wherein the first face comprises a first flat surface;

a contact member disposed in association with the ball member, wherein the contact member comprises a second face, and wherein the second face comprises a second flat surface; and a biasing member disposed in association with the contact member, wherein the biasing member is operable to apply a force to the contact member to force the second face against the first face to urge relative angular movement of the first sub and the second sub toward a relative angular position in which a central axis of the first sub and a central axis of the second sub are axially aligned.

6. The apparatus of claim 5 wherein the biasing member is operable to apply a force to the contact member to force the second face against the first face to urge relative angular movement of the contact member with respect to the ball member:

from a first position in which the first face and the second face are at a relative angle and the central axis of the second sub is not axially aligned with the central axis of the first sub; and to a second position in which the first face and the second face are flush against each other and the central axis of the second sub is axially aligned with the central axis of the first sub.

7. The apparatus of claim 5 wherein the ball member and the contact member each comprise a bore extending therethrough.

8. The apparatus of claim 5 wherein the contact member comprises:

a first portion having the second face; and a second portion extending perpendicularly with respect to the second face, wherein the biasing member is disposed:

about the second portion; and against the first portion opposite the second face.

9. The apparatus of claim 5 wherein the biasing member comprises a spring.

10. The apparatus of claim 5 wherein:

the first sub comprises a first body;

the second sub comprises a second body; and the ball member, the contact member, and the biasing member are disposed within the second body.

11. An apparatus comprising:

a downhole tool operable to connect within a tool string, wherein the downhole tool is operable to connect together a first portion of the tool string and a second portion of the tool string and facilitate relative angular movement between the first portion of the tool string and the second portion of the tool string when the downhole tool is connected within the tool string, and wherein the downhole tool comprises:

a first body;

a second body;

a ball member connected to the first body and disposed within the second body, wherein the ball member comprises a first face;

a contact member disposed within the second body, wherein the contact member comprises a second face; and a biasing member disposed within the second body, wherein the biasing member is operable to apply a force to the contact member to force the second face against the first face to thereby urge angular movement of the second body with respect to the first body toward a relative angular position in which a central axis of the second body is axially aligned with a central axis of the first body.

12. The apparatus of claim 11 wherein the biasing member is operable to apply a force to the contact member to force the second face against the first face to urge relative angular movement of the contact member with respect to the ball member:

from a first position in which the first face and the second face are at a relative angle and the central axis of the second body is not axially aligned with the central axis of the first body; and to a second position in which the first face and the second face are flush against each other and the central axis of the second body is axially aligned with the central axis of the first body.

13. The apparatus of claim 11 wherein the ball member and the contact member each comprise a bore extending therethrough.

14. The apparatus of claim 11 wherein the first face comprises a first flat surface, and wherein the second face comprises a second flat surface.

15. The apparatus of claim 11 wherein:

the contact member is connected to a sleeve;

the contact member and the sleeve collectively define an axial passage; and the biasing member is disposed about the sleeve.

16. An apparatus comprising:

a downhole tool operable to connect within a tool string, wherein the downhole tool is operable to connect together a first portion of the tool string and a second portion of the tool string and facilitate relative angular movement between the first portion of the tool string and the second portion of the tool string when the downhole tool is connected within the tool string, and wherein the downhole tool comprises:

a first body;

a second body;

a ball member connected to the first body and disposed within the second body, wherein the ball member comprises a first face;

a ring disposed within the second body, wherein the ring comprises a second face, wherein the ring is connected to a sleeve, and wherein the ring and the sleeve collectively define an axial passage; and a biasing member disposed within the second body, wherein the biasing member is disposed about the sleeve, and wherein the biasing member is operable to apply a force to the ring to force the second face against the first face to urge relative angular movement of the ball member and the ring to thereby urge relative angular movement of the first body and the second body toward a relative angular position in which a central axis of the first body and a central axis of the second body are axially aligned.

17. The apparatus of claim 16 wherein the first face comprises a first flat surface, and wherein the second face comprises a second flat surface.

18. An apparatus comprising:

a downhole tool operable to connect within a tool string, wherein the downhole tool is operable to connect together a first portion of the tool string and a second portion of the tool string and facilitate relative angular movement between the first portion of the tool string and the second portion of the tool string when the downhole tool is connected within the tool string, and wherein the downhole tool comprises:

a first sub;

a second sub;

a movable joint movably connecting together the first sub and the second sub to facilitate relative angular movement between the first sub and the second sub, wherein the movable joint comprises a ball member, and wherein the ball member comprises a first face;

a contact member disposed in association with the ball member, wherein the contact member comprises a second face, wherein the contact member is connected to a sleeve, and wherein the contact member and the sleeve collectively define an axial passage; and a biasing member disposed in association with the contact member, wherein the biasing member is disposed about the sleeve, and wherein the biasing member is operable to apply a force to the contact member to force the second face against the first face to urge relative angular movement of the first sub and the second sub toward a relative angular position in which a central axis of the first sub and a central axis of the second sub are axially aligned.

19. The apparatus of claim 18 wherein the first face comprises a first flat surface, and wherein the second face comprises a second flat surface.

* * * * *